US009349578B2

(12) United States Patent
Kim et al.

(10) Patent No.: US 9,349,578 B2
(45) Date of Patent: May 24, 2016

(54) QUANTITATIVE ANALYSIS METHOD USING MASS SPECTROMETRY WHEREIN LASER PULSE ENERGY IS ADJUSTED

(71) Applicant: ASTA CO., LTD., Suwon-si, Gyeonggi-do (KR)

(72) Inventors: Myung Soo Kim, Seoul (KR); Yong Jin Bae, Seoul (KR)

(73) Assignee: ASTA CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/759,168

(22) PCT Filed: Jan. 3, 2014

(86) PCT No.: PCT/KR2014/000054
§ 371 (c)(1),
(2) Date: Jul. 2, 2015

(87) PCT Pub. No.: WO2014/107047
PCT Pub. Date: Jul. 10, 2014

(65) Prior Publication Data

US 2016/0056027 A1 Feb. 25, 2016

(30) Foreign Application Priority Data

Jan. 3, 2013 (KR) ..... 10-2013-0000816

(51) Int. Cl.
*H01J 49/00* (2006.01)
*H01J 49/16* (2006.01)

(52) U.S. Cl.
CPC ..... *H01J 49/0031* (2013.01); *H01J 49/164* (2013.01)

(58) Field of Classification Search
CPC ..... H01J 49/0031; H01J 49/164
USPC ..... 250/281, 282; 436/173
See application file for complete search history.

(56) References Cited

U.S. PATENT DOCUMENTS

2007/0099305 A1 5/2007 Oas et al.

FOREIGN PATENT DOCUMENTS

KR 10-2014-0009641 A 1/2014

OTHER PUBLICATIONS

Bae, et al ("Reproducibility of Temperature-Selected Mass Spectra in Matrix-Assisted Laser Desorption Ionization of Peptides" Anal. Chem., Jul. 30, 2012, vol. 84, pp. 7107-7111).*
PCT International Search Report, PCT/KR2014/000054, Apr. 24, 2014, 4 Pages.

(Continued)

*Primary Examiner* — Michael Maskell
(74) *Attorney, Agent, or Firm* — Fenwick & West LLP

(57) ABSTRACT

A quantitative analysis method using MALDI mass spectrometry wherein laser pulse energy is adjusted is disclosed. More particularly, a method for measuring the equilibrium constant of a proton exchange reaction between a matrix and a sample at a constant temperature, by dividing an ion signal ratio by a value (concentration ratio) obtained by dividing the concentration of the sample by the concentration of the matrix, may include (i) obtaining MALDI mass spectra having constant TICs by adjusting the intensity of energy applied to a specimen having a predetermined amount of a matrix and a predetermined amount of a sample mixed therein and (ii) measuring the MALDI mass spectra obtained in step (i) for a value (ion signal ratio) obtained by dividing sample ion signal strength by matrix ion signal strength.

17 Claims, 25 Drawing Sheets

(56) References Cited

OTHER PUBLICATIONS

Armstrong, Daniel W., et al., "Ionic Liquids as Matrixes for Matrix-Assisted Laser Desorption/Ionization Mass Spectrometry," Analytical Chemistry, 2001, pp. 3679-3686, vol. 73, No. 15.
Bae, Yong Jin, et al., "Degree of Ionization in MALDI of Peptides: Thermal Explanation for the Gas-Phase Ion Formation," American Society for Mass Spectrometry, Jun. 1, 2012, pp. 1326-1335, vol. 23.
Bae, Yong Jin, et al., "Reproducibility of Temperature-Selected Mass Spectra in Matrix-Assisted Laser Desorption Ionization of Peptides," Analytical Chemistry, Jul. 30, 2012, pp. 7107-7111, vol. 84.
Park, Kyuang Man, et al., A Simple Method for Quantification of Peptides and Proteins by Matrix-Assisted Laser Desorption Ionization Mass Spectrometry, Analytical Chemistry, Nov. 12, 2002, pp. 10332-10337, vol. 84.
Bae, Y.J. et al., "Expansion Cooling in the Matrix Plume is Under-Recognized in MALDI Mass Spectrometry," *J. American Society for Mass Spectrometry*, 2011, pp. 1070-1078, vol. 22.
Bae, Y.J. et al., "Optimization of Reflectron for Kinetic and Mechanistic Studies with Multiplexed Multiple Tandem ($MS^n$) Time-of-flight Mass Spectrometry," *Bull. Korean Chem. Soc.*, 2010, pp. 92-99, vol. 31, No. 1.
Campbell, J. et al., "Fragmentation of Leucine Enkephalin as a Function of Laser Fluence in a MALDI TOF-TOF," *J. American Society for Mass Spectrometry*, 2007, pp. 607-616, vol. 18.
Koubenakis, A. et al., "Time-Resolved Surface Temperature Measurement of MALDI Matrices under Pulsed UV Laser Irradiation," *J. Phys. Chem. A*, 2004, pp. 2405-2410, vol. 108.
Moon, J. H. et al., "Temperature of Peptide Ions Generated by Matrix-Assisted Laser Desorption Ionization and Their Dissociation Kinetic Parameters," *J. Phys. Chem. B*, 2009, pp. 2071-2076, vol. 113.
Mowry, C.D. et al., Internal Energy of Neutral Molecules Ejected by Matrix-Assisted Laser Desorption, *J. Phys. Chem.*, 1994, pp. 1904-1909, vol. 98.
Yoon, S.H. et al., "A Comparative Study of In- and Post-Source Decays of Peptide and Preformed Ions in Matrix-Assisted Laser Desorption Inization Time-of-Flight Mass Spectrometry: Effective Temperature and Matrix Effect," *J. American Society for Mass Spectrometry*, 2010, pp. 1876-1883, vol. 21.
Yoon, S.H. et al., "A deflection system to reduce the interference from post-source decay product ions in photodissociation tandem time-of-flight mass spectrometry," *Rapid Communication in Mass Spectrometry*, 2006, pp. 2201-2208, vol. 20.

* cited by examiner

QUANTITATIVE ANALYSIS METHOD USING MASS SPECTROMETRY WHEREIN LASER PULSE ENERGY IS ADJUSTED

TECHNICAL FIELD

The present invention relates to a method for quantitative analysis using mass spectrometry wherein laser pulse energy is adjusted. More particularly, the present invention relates to a method for measuring the equilibrium constant of a proton exchange reaction between a matrix and an analyte at constant temperature, including: (i) obtaining MALDI mass spectra having the same total ion count (TIC) by adjusting the intensity of energy applied to a sample having a predetermined amount of matrix and a predetermined amount of analyte mixed therein; and (ii) measuring the value obtained by dividing the signal intensity of the analyte ion by the signal intensity of the matrix ion (ion signal ratio) from the MALDI mass spectra obtained in the step (i), wherein the ion signal ratio is divided by the concentration of the analyte divided by the concentration of the matrix (concentration ratio) to measure the equilibrium constant. The present invention also relates to a method for obtaining a calibration curve for MALDI mass spectrometry and a method for quantitative analysis of an analyte using MALDI mass spectrometry.

BACKGROUND ART

Matrix-assisted laser desorption/ionization (MALDI) is a method allowing for ionization of chemical compounds. Usually, it is used together with a time-of-flight (TOF) mass analyzer and is widely used for mass spectrometric analysis of chemicals. Because of wide range of analytes that can be analyzed and short analysis time, the MALDI-TOF mass spectrometric technique is widely used for structural analysis of various solid materials, particularly biomolecules.

However, because of very poor reproducibility of MALDI mass spectral patterns, it is difficult to use MALDI mass spectrometry for quantitative analysis of analytes. For this reason, the industrial or scientific applications of MALDI mass spectrometry are very limited.

For quantitative analysis of an analyte using MALDI mass spectrometry, various MALDI mass spectrometric techniques have been developed, including relative quantification without using an internal standard, relative quantification using an internal standard, absolute quantification using an internal standard, and absolute quantification using an analyte added.

The relative quantification without using an internal standard (or profile analysis) is a MALDI mass spectrometric method wherein a classification algorithm is used for reproducible analysis of MALDI mass spectra based on the fact that the relative signal intensity of each component in the MALDI mass spectra is constant. However, the weakness of the profile analysis method is that the design and practice of experiments are difficult.

The relative quantification using an internal standard is a MALDI mass spectrometric method wherein an analyte is quantified by measuring the peak height or area of each analyte in the MALDI mass spectra of samples to which a predetermined amount of an internal standard has been added relative to the peak height or area of the internal standard. However, with the relative quantification method using an internal standard, the absolute amount of the analyte cannot be determined.

The absolute quantification using an internal standard is a MALDI mass spectrometric method wherein a calibration curve is constructed from several samples containing different amount of an analyte to be measured as well as a constant amount of an internal standard, and the absolute amount of the analyte is determined from the calibration curve based on the relative amount of the analyte obtained from an unknown sample according to the relative quantification method using an internal standard described above. However, the absolute quantification method using an internal standard is disadvantageous in that a calibration curve has to be constructed for each component if a sample containing multiple components is to be analyzed.

The absolute quantification using an analyte added is a MALDI mass spectrometric method wherein a sample containing an analyte to be analyzed is divided into two or more samples, calibration points are obtained from the MALDI mass spectra obtained for the samples containing different amounts of the analyte, and the absolute amount of the analyte is determined from the calibration points. However, the absolute quantification method using an analyte added has the problem that the analyte to be analyzed needs to be prepared additionally and several samples are needed for the analysis of one analyte.

The currently known methods for quantitative analysis using MALDI mass spectra use an internal standard, particularly a compound identical to the analyte but substituted with an isotope. However, when the analyte has a large molecular weight, such as proteins, nucleic acids, etc., or when the degree of isotopic substitution is increased to distinguish the mass spectrum of the analyte substituted with the isotope from that of the unsubstituted analyte, the cost increases greatly. Another disadvantage of the MALDI mass spectrometry-based quantitative analysis using an internal standard is that the analyte pretreatment is not simple.

Since the sample in MALDI mass spectrometry is usually a mixture of an analyte and a matrix, an analyte ion (AH+) and fragmentation products thereof and a matrix ion (MH+) and fragmentation products thereof appear in the MALDI mass spectrum. Accordingly, the MALDI spectral pattern is determined by the fragmentation patterns of AH+ and MH+ and the ratio of the intensities of AH+ and MH+.

The ions generated by MALDI can be fragmented inside (in-source decay, ISD) or outside (post-source decay, PSD) the ion sources. The ISD occurs and terminates fast, whereas the PSD occurs slowly. The rate and yield of the fragmentation reaction of the analyte ion are determined by the reaction rate constant and the internal energy of the ion. Accordingly, if the effective temperature of a plume generated by a laser pulse in MALDI is known, the internal energy can be determined and the reaction rate can be calculated therefrom.

There have been many scientific researches to find out the temperature of a plume, which is a gas containing ions and neutral molecules generated when a laser is irradiated on a sample in MALDI mass spectrometry (J. Phys. Chem. 1994, 98, 1904-1909; J. Am. Soc. Mass Spectrom. 2007, 18, 607-616; J Phys. Chem. A 2004, 108, 2405-2410).

However, the most systematic method for measuring the plume temperature was first presented by the inventors of the present disclosure (J. Phys. Chem. B 2009, 113. 2071-2076). The inventors of the present disclosure have succeeded in obtaining the ion fragmentation reaction rate and effective temperature through kinetic analysis of time-resolved photodissociation spectra and PSD spectra. The obtained temperature was found to be the late plume temperature ($T_{late}$). The inventors of the present disclosure could also determine the early plume temperature ($T_{early}$) by analyzing the ISD yield using a reaction rate function obtained therefrom.

First, the inventors of the present disclosure measured the intensities of the fragmented ion products of peptide ions generated by ISD, PSD, etc. from MALDI spectra. From the data, the survival probabilities (Sin) of the peptide ions at the ion source exit were calculated. The maximum rate constant at which the peptide ions can survive at the ion source exit was obtained in consideration of the experimental conditions and the maximum internal energy corresponding thereto was determined from the fragmentation rate constant of the peptide ions. The internal energy distribution of the peptide ions was obtained while varying temperatures and $T_{early}$, i.e. the temperature at which the probability of the region below the maximum internal energy is identical to Sin, was determined.

The early and late temperatures of the ion-containing gas (plume) determined by the method devised by the inventors of the present disclosure matched well with those reported previously by other researchers. However, the method of the inventors of the present disclosure is advantageous in that it is methodologically more systematic and more universally applicable due to the lack of randomness, when compared with the methods devised by other researchers (Journal of the American Society for Mass Spectrometry, 2011, vol. 22, pp. 1070-1078).

In addition, the inventors of the present disclosure have surprisingly found out that, although the early plume temperature ($T_{early}$) varies if the MALDI experimental condition is changed, the mass spectral patterns of the spectrums with the same $T_{early}$ are identical even when the mass spectra are obtained under different experimental conditions (Korean Patent Application No. 10-2012-0075891).

The inventors of the present disclosure have found out that, if $T_{early}$ is the same, not only the mass spectral pattern but also the total number of generated ions (total ion count, TIC) is also the same. This suggests that mass spectra can be obtained at the same $T_{early}$ by maintaining $T_{early}$ by adjusting the energy intensity of a laser pulse irradiated to a sample.

In addition, the inventors of the present disclosure have found out that the reaction quotient of the proton exchange reaction of the plume (Q=[M][AH+]/([MH+][A])) obtained from the spectra having the same $T_{early}$ is constant for regardless of the change in analyte concentration in the solid samples. That is to say, the inventors of the present disclosure have found out that in MALDI-TOF mass spectrometry the early plume is almost in thermal equilibrium and the reaction quotient (Q) is equal to the equilibrium constant (K) of the proton exchange reaction between the matrix and the analyte. Accordingly, in MALDI-TOF mass spectra the ratio of the intensities of the analyte and matrix ions generated under a constant-temperature condition is directly proportional to the analyte-to-matrix molar ratio in the solid sample and quantitative analysis will be possible based thereon.

The inventors of the present disclosure have invented a method for measuring the equilibrium constant of an ionization reaction between a matrix and an analyte, wherein MALDI spectra are obtained at the same $T_{early}$ by adjusting the intensity of a laser pulse irradiated to a sample and the ratio of the signal intensity of the matrix ion and the signal intensity of the analyte ion is measured from the obtained MALDI spectra.

In addition, the inventors of the present disclosure have invented a method for obtaining a calibration curve for the change in the ratio of the concentrations of a matrix and an analyte at constant temperature using the equilibrium constant of the reaction between the matrix and the analyte.

Also, the inventors of the present disclosure have invented a method for quantitative analysis of measuring the amount of an analyte included in a sample prepared by mixing a predetermined amount of a matrix with an unknown amount of the analyte by calculating the moles of the analyte by substituting the ratio of the signal intensity of the analyte ion and the signal intensity of the matrix ion measured from the mass spectra of the sample as well as the concentration of the matrix into the calibration curve.

DISCLOSURE

Technical Problem

It is a first object of the present disclosure to provide a method for measuring the equilibrium constant of a proton exchange reaction between a matrix and an analyte at constant temperature, including: (i) obtaining MALDI mass spectra having the same total ion count (TIC) by adjusting the intensity of energy applied to a sample having a predetermined amount of matrix and a predetermined amount of analyte mixed therein; and (ii) measuring the value obtained by dividing the signal intensity of the analyte ion by the signal intensity of the matrix ion (ion signal ratio) from the MALDI mass spectra obtained in the step (i), wherein the ion signal ratio is divided by the concentration of the analyte divided by the concentration of the matrix (concentration ratio) to measure the equilibrium constant.

It is a second object of the present disclosure to provide a method for obtaining a calibration curve for MALDI mass spectrometry, including: (i) obtaining MALDI mass spectra having the same total ion count (TIC) by adjusting the intensity of energy applied to a sample having a predetermined amount of matrix and a predetermined amount of analyte mixed therein; (ii) measuring the value obtained by dividing the signal intensity of the analyte ion by the signal intensity of the matrix ion (ion signal ratio) from the MALDI mass spectra obtained in the step (i); and (iii) obtaining a calibration curve for MALDI mass spectrometry by plotting the ion signal ratio against the concentration of the analyte divided by the concentration of the matrix (concentration ratio).

It is a third object of the present disclosure to provide a method for quantitative analysis of an analyte using MALDI mass spectrometry, including: (i) obtaining MALDI mass spectra having the same total ion count (TIC) by adjusting the intensity of energy applied to a sample having a predetermined amount of matrix and a predetermined amount of analyte mixed therein; (ii) measuring the value obtained by dividing the signal intensity of the analyte ion by the signal intensity of the matrix ion (ion signal ratio) from the MALDI mass spectra obtained in the step (i); and (iii) calculating the molar concentration of the analyte by substituting the molar concentration of the matrix and the ion signal ratio obtained in the step (ii) into a calibration curve for MALDI mass spectrometry.

Technical Solution

The first object of the present disclosure described above can be achieved by providing a method for measuring the equilibrium constant of a proton exchange reaction between a matrix and an analyte at constant temperature, including: (i) obtaining MALDI mass spectra having the same total ion count (TIC) by adjusting the intensity of energy applied to a sample having a predetermined amount of matrix and a predetermined amount of analyte mixed therein; and (ii) measuring the value obtained by dividing the signal intensity of the analyte ion by the signal intensity of the matrix ion (ion signal ratio) from the MALDI mass spectra obtained in the step (i), wherein the ion signal ratio is divided by the concentration of the analyte divided by the concentration of the matrix (concentration ratio) to measure the equilibrium constant.

In the present disclosure, the term "matrix" refers to a material which absorbs energy from an energy source such as a laser and transfers the energy to an analyte, thereby heating and ionizing the analyte. The matrix used in MALDI mass spectrometry may be selected from CHCA (α-cyano-4-hydroxycinnamic acid), DHB (2,5-dihydroxybenzoic acid), sinapinic acid, 4-hydroxy-3-methoxycinnamic acid, picolinic acid, 3-hydroxypicolinic acid, 2,6-dihydroxyacetophenone, 1,5-diaminonapthalene, 2,4,6-trihydroxyacetophenone, 2-(4'-hydroxybenzeneazo)benzoic acid, 2-mercaptobenzothiazole, chlorocyanocinnamic acid, fluorocyanocinnamic acid, etc.

In the method for measuring the equilibrium constant of a proton exchange reaction between a matrix and an analyte at constant temperature of the present disclosure, a means of applying energy to the sample may be a laser, a particle beam or other forms of radiation. The laser may be a nitrogen laser or a Nd:YAG laser. Specifically, the laser may be irradiated to one spot of the sample multiple times or may be irradiated to multiple spots of the sample to obtain multiple spectra of the analyte ion.

In the method for measuring the equilibrium constant of a proton exchange reaction between a matrix and an analyte at constant temperature of the present disclosure, the size of the sample may be equal to or smaller than the spot size of the laser beam. A sample prepared using a microspotter is very uniform in size. If the size of the sample is similar to the laser spot size, the linearity of a calibration curve and the reproducibility of spectra are remarkably improved.

In typical MALDI mass spectrometry, a laser pulse is irradiated to a solid sample consisting of a matrix (M) and a trace amount of an analyte (A). The matrix helps the absorption of the laser and, thus, the heating and ionization of the analyte. The resulting MALDI mass spectrum is a spectrum of a fragmented mixture of a matrix ion and an analyte ion.

The method of the present disclosure is applicable to quantitative analysis of not only macromolecules such as proteins, nucleic acids, peptides, metabolites, drugs, vitamins, sugars, toxic substances, harmful materials, etc. but also small molecules.

In the present disclosure, the term "total ion count (TIC)" refers to the total number of particles detected by a detector inside a mass spectrometer. Since part of the ions generated inside the mass spectrometer by MALDI are lost due to fragmentation, it is not easy to measure the total number of the ions generated by MALDI. Therefore, the total number of particles detected by a detector is defined as the total ion count as a measure of the total number of the ions generated by MALDI.

In the present disclosure, the term "plume" refers to a vapor generated from a sample by the energy of a laser pulse irradiated to the sample. The plume contains gaseous matrix molecules, analyte molecules, matrix ions and analyte ions. Among them, the gaseous matrix molecules constitute the most part of the plume.

In the present disclosure, the term "reaction quotient" is defined as $Q=([C]^c[D]^d)/([A]^a[B]^b)$ for a reaction $aA+bB \rightarrow cC+dD$. When the chemical reaction is at equilibrium, the reaction quotient is equal to the equilibrium constant.

In the present disclosure, the term "calibration curve" or "calibration equation" refers to an empirically obtained curve about the relationship between the concentration of a component and the particular property of the component (e.g., electrical property, color development, etc.). The calibration curve is used for quantitative analysis of a component with an unknown concentration.

In the present disclosure, the term "ion signal ratio" is defined as the value obtained by dividing the signal intensity of an analyte ion ($I_{AH+}$) by the signal intensity of a matrix ion ($I_{MH+}$). And, in the present disclosure, the term "concentration ratio" is defined as the value obtained by dividing the moles of an analyte contained in a sample by the moles of a matrix contained in the sample ([A]/[M]).

The ions appearing on a MALDI mass spectrum are protonated analyte ($AH^+$), protonated matrix ($MH^+$) and fragmented products thereof generated in an ion source. Accordingly, the pattern of a MALDI mass spectrum is determined by fragmentation pattern of $AH^+$ and $MH^+$ and the analyte-to-matrix ion ratio.

The inventors of the present disclosure have invented and reported a method for determining the temperature of the early plume ($T_{early}$) generated by MALDI (Bae, Y. J.; Moon, J. H.; Kim, M. S. J. Am. Soc. Mass Spectrom. 2011, 22, 1070-1078; Yoon, S. H.; Moon, J. H.; Kim, M. S. J. Am. Soc. Mass Spectrom. 2010, 21, 1876-1883). The inventors of the present disclosure have also found out that the three factors are determined if $T_{early}$ is specified.

In addition, the inventors of the present disclosure have found out that, although the early plume temperature ($T_{early}$) varies if the MALDI experimental condition is changed in MALDI mass spectrometry, in the mass spectra with the same $T_{early}$, each mass spectral pattern exhibits the same total ion count (TIC). This phenomenon occurs also in the case where the sample contains the matrix and a third material in addition to the analyte.

Therefore, the inventors of the present disclosure could improve the reproducibility of MALDI mass spectra by adjusting the energy of the laser pulse irradiated to a sample and thereby obtaining the MALDI mass spectra having the same total ion count (TIC).

If MALDI spectra are obtained by irradiating a laser pulse to a sample with all the experimental conditions fixed, $T_{early}$ decreases gradually. This is because, as the analyte gets thinner, conduction of heat from the sample to the plate on which it is placed occurs more effectively (Anal. Chem. 2012, 84, 7107-7111). The decrease of $T_{early}$ is one of the causes of decreased shot-to-shot reproducibility of MALDI spectra.

In an exemplary embodiment of the present disclosure, in order to obtain MALDI spectra with constant TIC, or $T_{early}$, the energy of the laser pulse is increased as $T_{early}$ decreases due to the thinning of the analyte. Specifically, a circular neutral density filter may be used to adjust the laser pulse energy. The laser pulse energy may be adjusted by mounting the circular neutral density filter on a step motor and rotating the filter as desired.

The feedback control of the laser pulse energy may be achieved as follows. First, laser pulse energy corresponding two times the threshold energy may be set as a preset value for TIC. After obtaining MALDI spectra by irradiating a laser pulse, TIC is calculated from the spectra. Then, it is compared with the preset TIC value to determine the rotational direction and angle for the circular neutral density filter. This feedback control is resumed until the laser pulse energy exceeds three times the threshold energy. This procedure is repeated for each irradiated spot to obtain the MALDI spectra.

In a MALDI plume, a proton exchange reaction occurs between the matrix and the analyte as described in Reaction Formula (1):

$$MH^+ + A \rightarrow M + AH^+ \quad (1)$$

The reaction quotient of Reaction Formula (1) is defined by Equation (2).

$$Q=[M][AH^+]/([MH^+][A])=([M]/[A])/([MH^+]/[AH^+]) \quad (2)$$

In Equation (2), [M]/[A] can be obtained directly from the concentrations of the matrix and the analyte used for preparation of the sample.

And, in Equation (2), $[AH^+]/[MH^+]$ is the value obtained by dividing the concentration of the ions derived from the analyte by the concentration of the ions derived from the matrix and is equal to the value obtained by dividing the signal intensity of the analyte-derived ions by the signal intensity of the matrix-derived ions (ion signal ratio), i.e. $I_{AH+}/I_{MH+}$, obtained in the step (ii) of the method for measuring the reaction quotient of a proton exchange reaction of the present disclosure. Then, Equation (2) can be written as follows.

$$Q=([M]/[A])/(I_{AH+}/I_{MH+}) \quad (3)$$

Since both the [M]/[A] value and the $I_{AH+}/I_{MH+}$ value in Equation (3) can be obtained, the reaction quotient of a proton exchange reaction between the matrix and the analyte can be obtained. And, since this reaction is in equilibrium, the reaction quotient is equal to the equilibrium constant.

The second object of the present disclosure can be achieved by providing a method for obtaining a calibration curve for MALDI mass spectrometry, including: (i) obtaining MALDI mass spectra having the same total ion count (TIC) by adjusting the intensity of energy applied to a sample having a predetermined amount of matrix and a predetermined amount of analyte mixed therein; (ii) measuring the value obtained by dividing the signal intensity of the analyte ion by the signal intensity of the matrix ion (ion signal ratio) from the MALDI mass spectra obtained in the step (i); and (iii) obtaining a calibration curve for MALDI mass spectrometry by plotting the ion signal ratio against the concentration of the analyte divided by the concentration of the matrix (concentration ratio).

In the method for obtaining a calibration curve for MALDI mass spectrometry of the present disclosure, a means of applying energy to the sample may be a laser, a particle beam or other forms of radiation. The laser may be a nitrogen laser or a Nd:YAG laser. Specifically, the laser may be irradiated to one spot of the sample multiple times or may be irradiated to multiple spots of the sample to obtain multiple spectra of the analyte ion.

Also, in the method for obtaining a calibration curve for MALDI mass spectrometry of the present disclosure, the calibration curve for MALDI mass spectrometry may be obtained by plotting the change in the ion signal ratio obtained by repeating the steps (i)-(iii) multiple times after obtaining the MALDI mass spectra having the same total ion count (TIC) by adjusting the intensity of energy applied to the sample against the change in the concentration ratio and conducting linear regression analysis.

As described above, the fact that the analyte-to-matrix ion signal ratio is determined by the temperature ($T_{early}$) means that the proton exchange reaction is at thermal equilibrium. Whether the reaction of Reaction Formula (1) is at thermal equilibrium can be identified by investigating whether the reaction quotient (Q) at the same $T_{early}$ changes with the analyte concentration in samples with different analyte concentrations.

The inventors of the present disclosure have obtained spectra having the same $T_{early}$ but having different composition of the sample by irradiating a laser to multiple samples having different analyte concentrations while adjusting the laser pulse energy. In addition, the inventors of the present disclosure have measured the intensities of the ions derived from the matrix and the analyte for the obtained spectra.

As a result of calculating the reaction quotient by substituting the value obtained by dividing the analyte ion signal intensity by the matrix ion signal intensity (ion signal ratio) and the matrix concentration and the analyte concentration of the sample into Equation (3), the inventors of the present disclosure have found out that the reaction quotient is constant if $T_{early}$ is the same, even when the concentration of the analyte included in the sample is different. This result means that the reaction of Reaction Formula (1) is at thermal equilibrium.

Because the proton exchange reaction between the matrix and the analyte is at equilibrium, the reaction quotient (Q) in Equations (2) and (3) can be replaced by the equilibrium constant (K). Then, Equations (2) and (3) can be written as Equation (4).

$$K=[M][AH^+]/([MH^+][A])=([AH^+]/[MH^+])/([A]/[M])=(I_{AH+}/I_{MH+})/([A]/[M]) \quad (4)$$

Because the amount of ions in the MALDI plume is much smaller than that of neutral molecules, it can be assumed that the ratio [A]/[M] in a solid sample is the same in the MALDI plume. From Equation (4), calibration equations are obtained as Equation (5) or (6).

$$[AH^+]/[MH^+]=K([A]/[M]) \quad (5)$$

$$I_{AH+}/I_{MH+}=K([A]/[M]) \quad (6)$$

From Equation (6), the slope of the calibration curve, i.e. the equilibrium constant, can be obtained with only one $I_{AH+}/I_{MH+}$ measurement value and one [A]/[M] value.

In addition, the slope of the calibration curve of Equation (6), i.e. the equilibrium constant, can also be obtained through statistical treatment, i.e. regression analysis, of multiple $I_{AH+}/I_{MH+}$ measurement values and multiple [A]/[M] values. In this case, a more accurate equilibrium constant can be obtained than when only one $I_{AH+}/I_{MH+}$ measurement value and one [A]/[M] value are used.

In an exemplary embodiment of the present disclosure, a line with a slope K can be obtained with $I_{AH+}/I_{MH+}$ (i.e., $[AH^+]/[MH^+]$) as the ordinate and [A]/[M] as the abscissa. This line is the calibration curve (or calibration equation) for MALDI mass spectrometry. The third object of the present disclosure can be achieved by providing a method for quantitative analysis of an analyte using MALDI mass spectrometry, including: (i) obtaining MALDI mass spectra having the same total ion count (TIC) by adjusting the intensity of energy applied to a sample having a predetermined amount of matrix and a predetermined amount of analyte mixed therein; (ii) measuring the value obtained by dividing the signal intensity of the analyte ion by the signal intensity of the matrix ion (ion signal ratio) from the MALDI mass spectra obtained in the step (i); and (iii) calculating the molar concentration of the analyte by substituting the molar concentration of the matrix and the ion signal ratio obtained in the step (ii) into a calibration curve for MALDI mass spectrometry of Equation (7).

$$[A]=(I_{AH+}/I_{MH+})[M]/K \quad (7)$$

In the method for quantitative analysis of an analyte using MALDI mass spectrometry of the present disclosure, a means of applying energy to the sample may be a laser, a particle beam or other forms of radiation. The laser may be a nitrogen laser or a Nd:YAG laser. The laser may be irradiated to one spot of the sample multiple times or may be irradiated to multiple spots of the sample to obtain multiple spectra of the analyte ion.

And, in the method for quantitative analysis of an analyte using MALDI mass spectrometry of the present disclosure, the size of the sample may be equal to or smaller than the spot size, or diameter, of the laser beam. A sample prepared using a microspotter is very uniform in size. If the size of the sample is similar to the laser spot size, the linearity of a calibration curve and the reproducibility of spectra are remarkably improved.

As can be seen from Equation (6), $I_{AH+}/I_{MH+}$ is proportional to [A]/[M]. This means that the amount of the analyte in the solid sample can be measured by measuring IAH+/IMH+ from the MALDI mass spectra. Equation (6) can be written as Equation (7).

$$[A]=(I_{AH+}/I_{MH+})[M]/K=(I_{AH+}/I_{MH+})[M]/Q \quad (7)$$

That is to say, in quantitative analysis using MALDI mass spectrometry, Equation (7) can be used as a calibration curve (or calibration equation) for obtaining the absolute amount of the analyte.

More specifically, the analyte concentration [A] can be calculated from the calibration curve (Equation (7)) obtained in the method for obtaining a calibration curve for MALDI mass spectrometry of the present disclosure using the ratio of the analyte ion signal intensity and the matrix ion signal intensity, i.e. $I_{AH+}/I_{MH+}$, obtained in the step (iii) of the method for quantitative analysis of an analyte using MALDI mass spectrometry of the present disclosure and the matrix concentration [M].

Since the equilibrium state of a chemical reaction is maintained even when another chemical reaction is also at equilibrium, Equation (7) holds for each component in the matrix plume. That is to say, the method of the present disclosure using MALDI-TOF mass spectra is applicable to quantitative analysis of a specific analyte even when the analyte or a sample is severely contaminated. Accordingly, the method of the present disclosure allows for quantitative analysis of various components of a mixture at the same time.

In the present disclosure, the term "matrix signal suppression effect" refers to a phenomenon of suppressed matrix ion signal occurring when the analyte is present in the sample at a very high concentration. And, in the present disclosure, the term "analyte signal suppression effect" refers to a phenomenon of suppressed analyte ion signal occurring when another analyte is present in the sample at a very high concentration.

Referring to Equation (3) about the reaction quotient, the number of the matrix ions decreases as the number of the analyte ions increases. This phenomenon is called in the present disclosure "normal signal suppression". And, if the analyte concentration is very high, i.e. if the matrix signal suppression effect is very large, the $(I_{AH+}/I_{MH+})$ vs. [A] curve does not show linearity. This phenomenon is called in the present disclosure "anomalous signal suppression".

Part of MH+ becomes $MH—H_2O^+$, $MH—CO_2^+$, etc. through in-source decay. Therefore, the total number of matrix-derived ions generated by MALDI is equal to the sum of the number of these ions. And, the number of matrix ions generated by MALDI is proportional to the number of MH+ appearing in the MALDI spectra. Accordingly, in the present disclosure, the number of MH+ appearing in the MALDI spectra is used instead of the total number of matrix-derived ions.

Let $I_0$ be the ion signal intensity of $MH^+$ in the MALDI spectra of a pure matrix and let I be the ion signal intensity of $MH^+$ for a matrix-analyte mixture. Then, the matrix signal suppression effect (S) of the mixture is defined by Equation (8):

$$S=1-I/I_0 \quad (8)$$

As a result of measurement made on many analytes, deviation from linearity occurred when the matrix signal suppression effect was larger than 70%. This may be used as a guideline in quantitative analysis of samples. The inventors of the present disclosure have obtained MALDI spectra of a sample and calculated the matrix signal suppression effect. If the matrix signal suppression effect is 70% or smaller, the mass spectra can be used for quantitative analysis of the analyte.

When a sample has a matrix signal suppression effect larger than 70%, the matrix signal suppression may be reduced through dilution according to Equation (9):

$$c_2/c_1=(S_1^{-1}-1)/(S_2^{-1}-1) \quad (9)$$

In Equation (9), $S_1$ and $S_2$ are matrix signal suppression effects when the concentration of an analyte 1 and an analyte 2 is $c_1$ and $c_2$, respectively.

Accordingly, if the matrix signal suppression effect exceeds 70% because the concentration of the analyte in the sample is too high, the sample may be diluted 2 or more times, specifically several times to hundreds of times.

Advantageous Effects

In accordance with the present disclosure, spectra having constant temperature ($T_{early}$) can be obtained through feedback control of laser pulse energy. As a result, reproducible MALDI spectra can be obtained more easily and quickly, which allow for quantitative analysis of a trace amount, e.g. 100 amol, of an analyte.

BEST MODE FOR CARRYING OUT INVENTION

Figure 1:
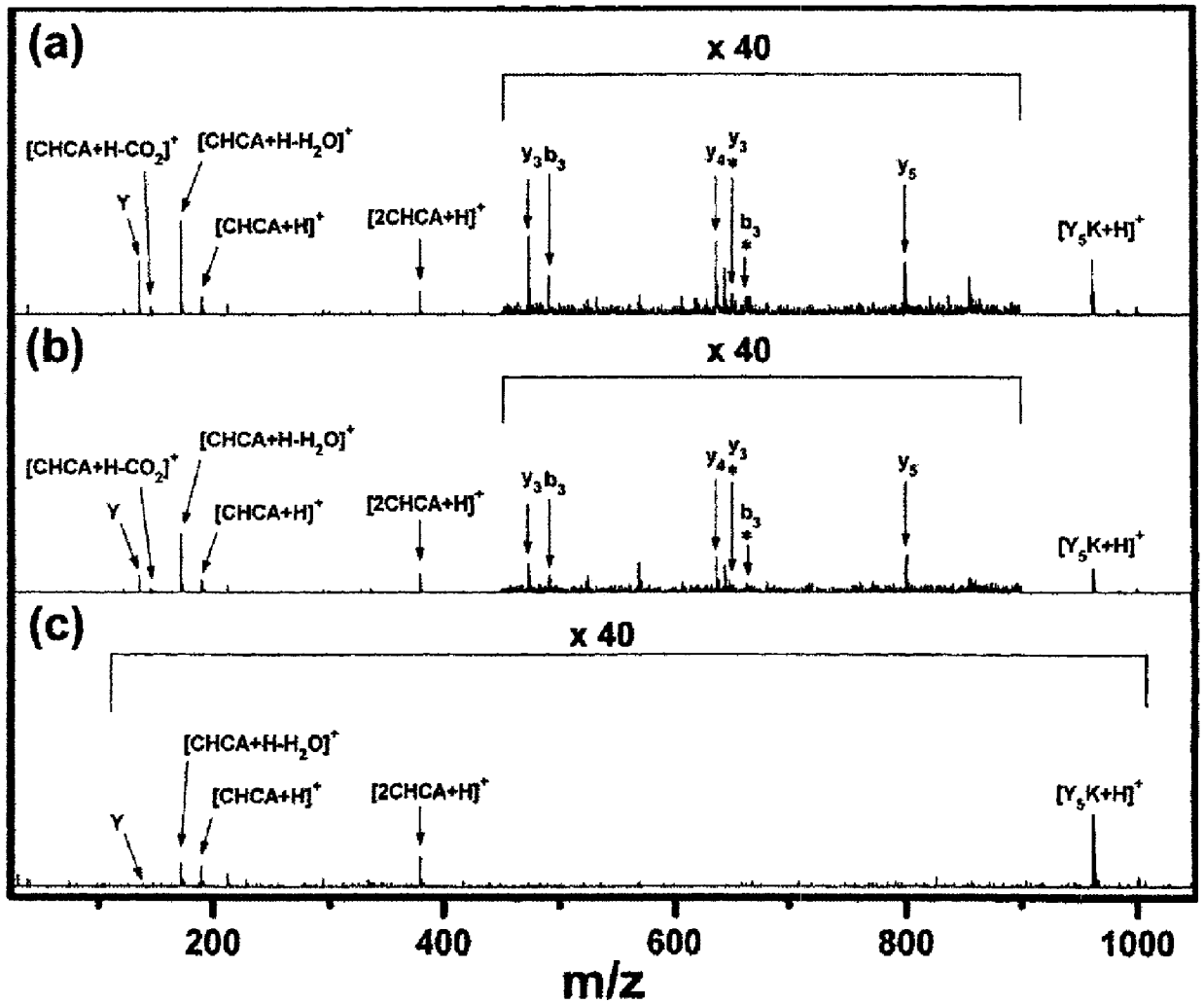
FIG. 1 shows MALDI spectra averaged in Example 3 over the shot number ranges of (a) 31-40, (b) 81-90 and (c) 291-300 of a laser pulse to one spot of a sample containing 25 nmol of CHCA and 10 pmol of $Y_5K$, obtained in Example 3.

Hereinafter, the present disclosure will be described in detail through examples. However, the following examples are for illustrative purposes only and it will be apparent to those of ordinary skill in the art that the scope of the present disclosure is not limited by the examples.

EXPERIMENTAL

In the following examples, a MALDI-TOF mass spectrometer developed by the inventors of the present disclosure was used (Bae, Y. J.; Shin, Y. S.; Moon, J. H.; Kim. M. S. J. Am. Soc. Mass Spectrom. 2012, 23, 1326-1335; Bae, Y. J.; Yoon, S. H.; Moon, J. H.; Kim, M. S. Bull. Korean Chem. Soc. 2010, 31, 92-99; Yoon, S. H.; Moon, J. H.; Choi, K. M.; Kim, M. S. Rapid Commun Mass Spectrom. 2006, 20, 2201-2208). The MALDI-TOF mass spectrometer was composed of an ion source with delayed extraction, a linear TOF analyzer, a reflectron and a detector. The 337-nm output from a nitrogen laser (MNL100, Lasertechnik Berlin, Berlin, Germany) focused by a lens with a focal length of 100 mm was used for MALDI. The threshold pulse energy at the sample position was 0.30 and 1.4 μJ/pulse for CHCA (α-cyano-4-hydroxycinnamic acid) and DHB (2,5-dihydroxybenzoic acid), respectively. To improve the signal-to-noise ratio, the obtained spectral data were averaged over 10 laser shots.

Example 1

Sample Preparation

As analytes, peptides $Y_6$, $Y_5K$ and angiotensin II (DRVYIHPF) were purchased from Peptron (Daejeon, Korea). Matrices CHCA and DHB were purchased from Sigma (St. Louis, Mo., USA). An aqueous solution of the analyte was mixed with a 1:1 water/acetonitrile solution of CHCA or DHB. In CHCA-MALDI, 1 μL of a solution containing 0-250 pmol of the analyte and 25 nmol of CHCA was loaded on the target and vacuum- or air-dried. Sampling for DHB-MALDI of $Y_6$ was carried out in two steps. In each step, 1 μL, of a solution containing 0.5-320 pmol of $Y_6$ in 50 nmol of DHB was loaded on the target and vacuum-dried.

Example 2

Measure of Spectral Temperature

Kinetic analysis of the fragmentation of the analyte ion is not necessary for measurement of $T_{early}$ in the MALDI spectrum. Rather, the fragmentation pattern of the matrix ion or the total number of generated ions can also be used as a measure of $T_{early}$. To obtain MALDI spectra having a specific $T_{early}$ while actively adjusting the factors affecting the $T_{early}$, a good measure of $T_{early}$ is necessary. A good measure of $T_{early}$ should satisfy the following criteria.

First, a measure of $T_{early}$ must be a sensitive function of $T_{early}$. Second, the measure of $T_{early}$ must be independent of the identities of the analytes, the concentrations of the analytes in a solid sample, and their numbers. Third, it should be possible to compute this property rapidly and straightforwardly from a spectrum.

The measurement of $T_{early}$ based on the fragmentation of peptide ion does not satisfy the second and third criteria. Also, when the fragmentation pattern of the matrix ion is used, the measurement of $T_{early}$ is difficult if the matrix ion signal is contaminated. The first and second criteria can be satisfied if the total number of ions generated in MALDI is used as a measure of $T_{early}$.

However, because it is not easy to count the total number of ions generated inside a reflectron due to loss of fragmentation products, the inventors of the present disclosure have defined the total number of particles detected by a detector as total ion count (TIC) and used it as a measure of $T_{early}$. To confirm that TIC is a function of $T_{early}$, the total number of ions generated per laser pulse and TIC when 25 nmol of CHCA was used as a matrix and the identities, concentrations and numbers of the analytes were varied were listed in Table 1.

TABLE 1

CHCA TIC versus analyte concentration in CHCA-MALDI

| Analyte | Analyte concentration (pmol)[a] | TIC per laser pulse[b] $T_{early}$ = 875 ± 5K | TIC per laser pulse[b] $T_{early}$ = 900 ± 5K |
|---|---|---|---|
| —[c] | 0 | 600 ± 60 | 1250 ± 130 |
| $Y_5K$ | 0.10 | 540 ± 90 | 1300 ± 80 |
| | 1.0 | 450 ± 50 | 1100 ± 110 |
| | 10 | 460 ± 50 | 1070 ± 70 |
| $Y_5R$ | 0.10 | 540 ± 50 | 1220 ± 40 |
| | 1.0 | 530 ± 160 | 1250 ± 130 |
| | 10 | 520 ± 100 | 1050 ± 120 |
| Mixture[d] | 1.0/analyte | 580 ± 50 | 1220 ± 30 |

[a]Picomoles (pmol) of analyte in 25 nmol of CHCA in solid sample.
[b]Averages over three or more measurements with one standard deviation.
[c] Pure CHCA.
[d]0.1 pmol each of $Y_5K$, $Y_5R$, YLYEIAR, YGGFL, creatinine and histamine in 25 nmol of CHCA.

From Table 1, it is evident that total ion count (TIC) is very sensitive to the change in $T_{early}$ (875 K→900 K) and is not significantly affected by the identities, concentrations and numbers of the analytes. Accordingly, it can be seen that it can be used as a measure of $T_{early}$ that satisfies the above-described three criteria.

Example 3

Quantitative Reproducibility of TIC-Selected Spectra

First, spectral changes occurring upon repetitive irradiation of a laser pulse were investigated. A set of MALDI spectra was taken from one spot of a vacuum-dried sample containing 10 pmol of $Y_5K$ in 25 nmol of CHCA using a laser pulse of two times the threshold pulse energy.

From this set, the spectra averaged over the shot number ranges of 31-40, 81-90 and 291-300 are shown in FIG. 1. The first 30 spectra were not used because contamination by alkali adduct ions was significant in those spectra. The total TICs summed over the above shot number ranges were 12000 (12000), 7300 (58000) and 110 (106000), respectively (The numbers in parentheses denote TICs accumulated in the shot number ranges of 31-40, 81-90 and 291-300, respectively.). Since temperature selection was not made, both the spectral pattern and the abundance of each ion changed as the laser shot continued. At the shot number range of 291-300, $[Y_5K+H]^+$ became more prominent than others. However, the absolute abundance at the shot number range of 291-300 was very low compared to those at the shot number range of 31-40 or 81-90. In fact, ion generation virtually stopped after the shot number 300. This does not mean that materials at the irradiated spot were completely depleted at the shot number 300 because ion generation resumed when the laser pulse energy was raised. This phenomenon occurs for the following reason. As the irradiated spot gets thinner, the temperature at the spot gets lower, eventually becoming lower than the threshold for ablation at the shot number 300. Then, the increase in the laser pulse energy raises the temperature above the ablation threshold and the ion generation resumes.

As previously reported by the inventors of the present disclosure, the MALDI spectra obtained from a sample with a given composition were quantitatively reproducible regardless of the experimental condition when the spectra with the same $T_{early}$ were selected. In this previous work, the $I([M+H-H_2O]^+)/I([M+H]^+)$ ratio was used as the measure of $T_{early}$.

Figure 2:
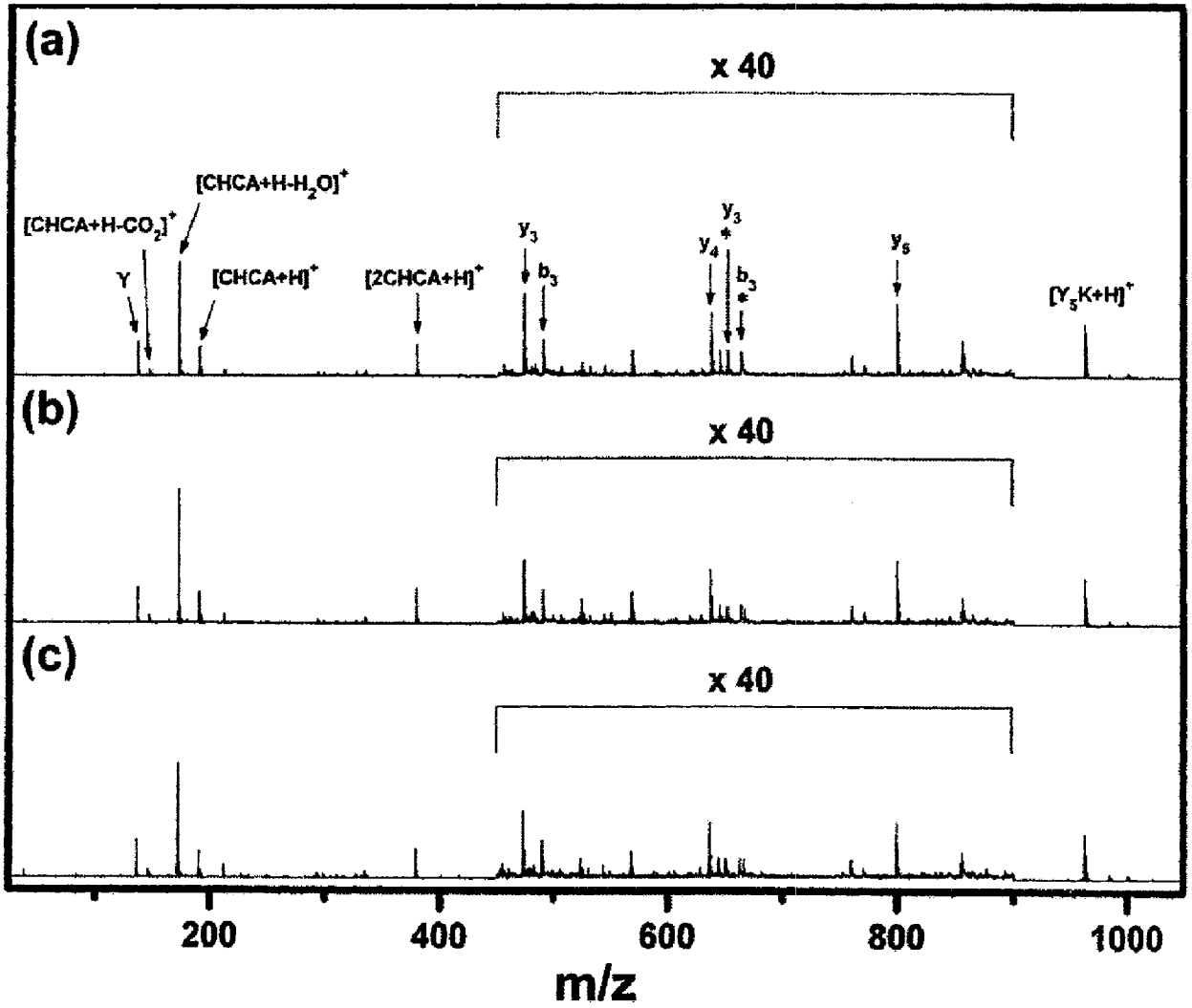
FIG. 2 shows TIC-selected MALDI spectra obtained in Example 3 after irradiating a laser pulse with (a) two times, (b) three times and (c) four times the threshold pulse energy to a vacuum-dried sample containing 25 nmol of CHCA and 10 pmol of $Y_5K$.

In the present disclosure, a similar measurement was made for a vacuum-dried sample containing 10 pmol of $Y_5K$ in 25 nmol of CHCA and selected spectra with TIC of 1100±200 ions/pulse. As shown in FIG. 2, the spectra thus obtained were virtually the same. A similar result was obtained also for the sample containing angiotensin II in CHCA. These results indicate that TIC is an excellent measure of $T_{early}$. Also, as a result of checking the spot-to-spot and sample-to-sample reproducibilities, it was found out that the strategy of spectral acquisition-temperature selection using TIC worked well.

Figure 3A:
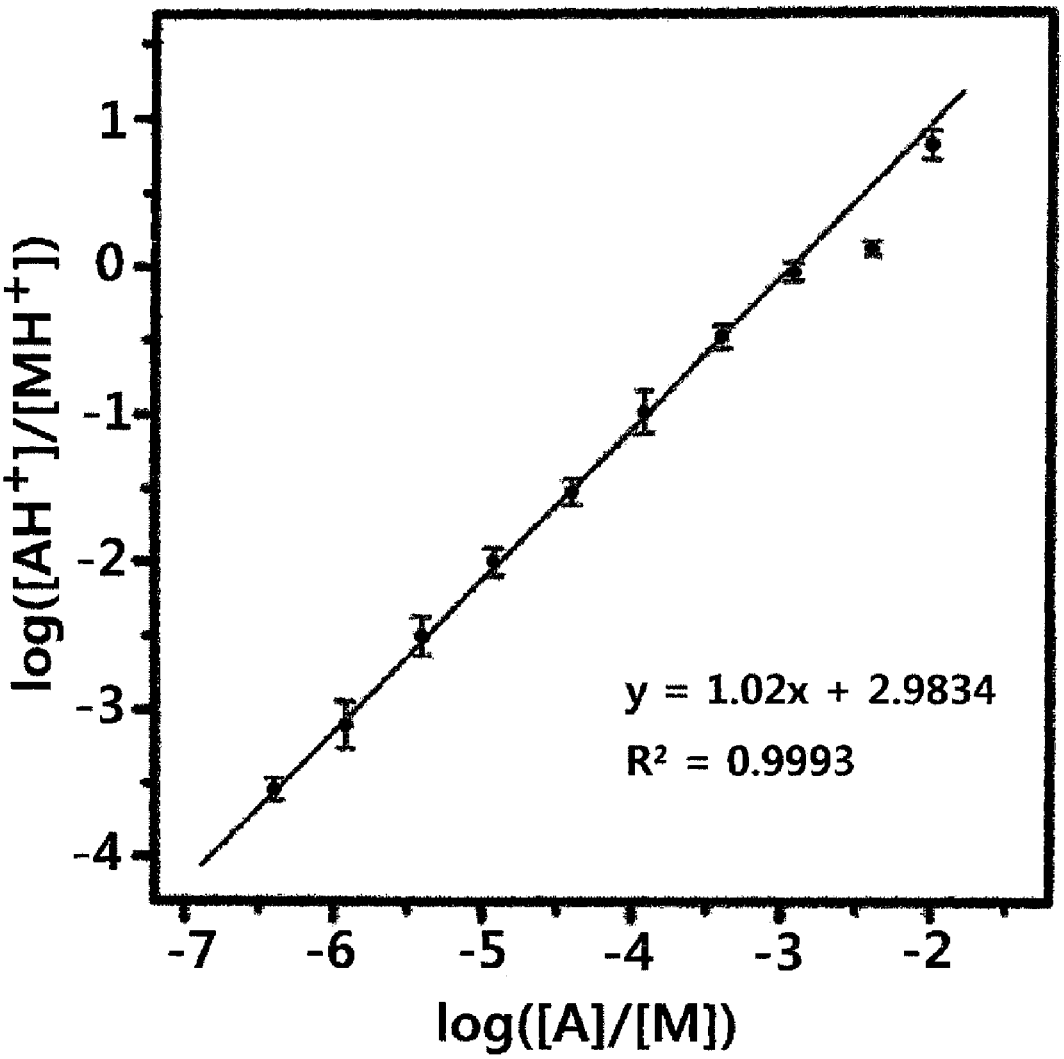
FIGS. 3*a*-3*c* show calibration curve in CHCA-MALDI of $Y_5K$ obtained by (a) TIC selection (900±180 ions/pulse), (b) by TIC control with the preset value of 900 ions/pulse and (c) in DHB-MALDI of $Y_6$ obtained by TIC control with the preset value of 1300 ions/pulse, in Examples 3 and 4.

MALDI spectra for vacuum-dried samples containing 0.01-250 pmol of $Y_5K$ in 25 nmol of CHCA were obtained, the spectra with TIC of 900±180 ions/pulse were selected, and $[AH^+]/[MH^+]$ versus [A]/[M] data were calculated from the selected spectra. The result is shown in FIG. 3*a*. The excellent linearity of the calibration curve demonstrates the utility of TIC for temperature selection.

Example 4

Acquisition of Reproducible Spectra by TIC Control

Laser pulse energy was adjusted for TIC control in MALDI spectra. The laser pulse energy was manually adjusted by rotating a circular variable neutral density filter (model CNDQ-4-100.OM, CVI Melles Griot, Albuquerque, N. Mex., USA) installed immediately after the laser. The circular variable neutral density filter was mounted on a step motor and the laser pulse energy was systematically adjusted by rotating the filter with a command from the data system.

The following negative feedback method was used for control of the laser pulse energy. At the beginning of data from a spot, the laser pulse energy was adjusted to two times the threshold energy and 10 single-shot spectra were averaged. From the obtained spectra, TIC was calculated and compared with a preset value, thereby calculating the adjustment needed for the next laser shot. The result was used to determine the rotational direction and angle of the filter. After the angular adjustment of the filter, spectral acquisition was resumed. The spectral acquisition from the sot was terminated when the material in the spot was depleted by repetitive laser irradiation. For CHCA-MALDI, the termination was made when the laser pulse energy became three times the threshold energy.

Figure 4:
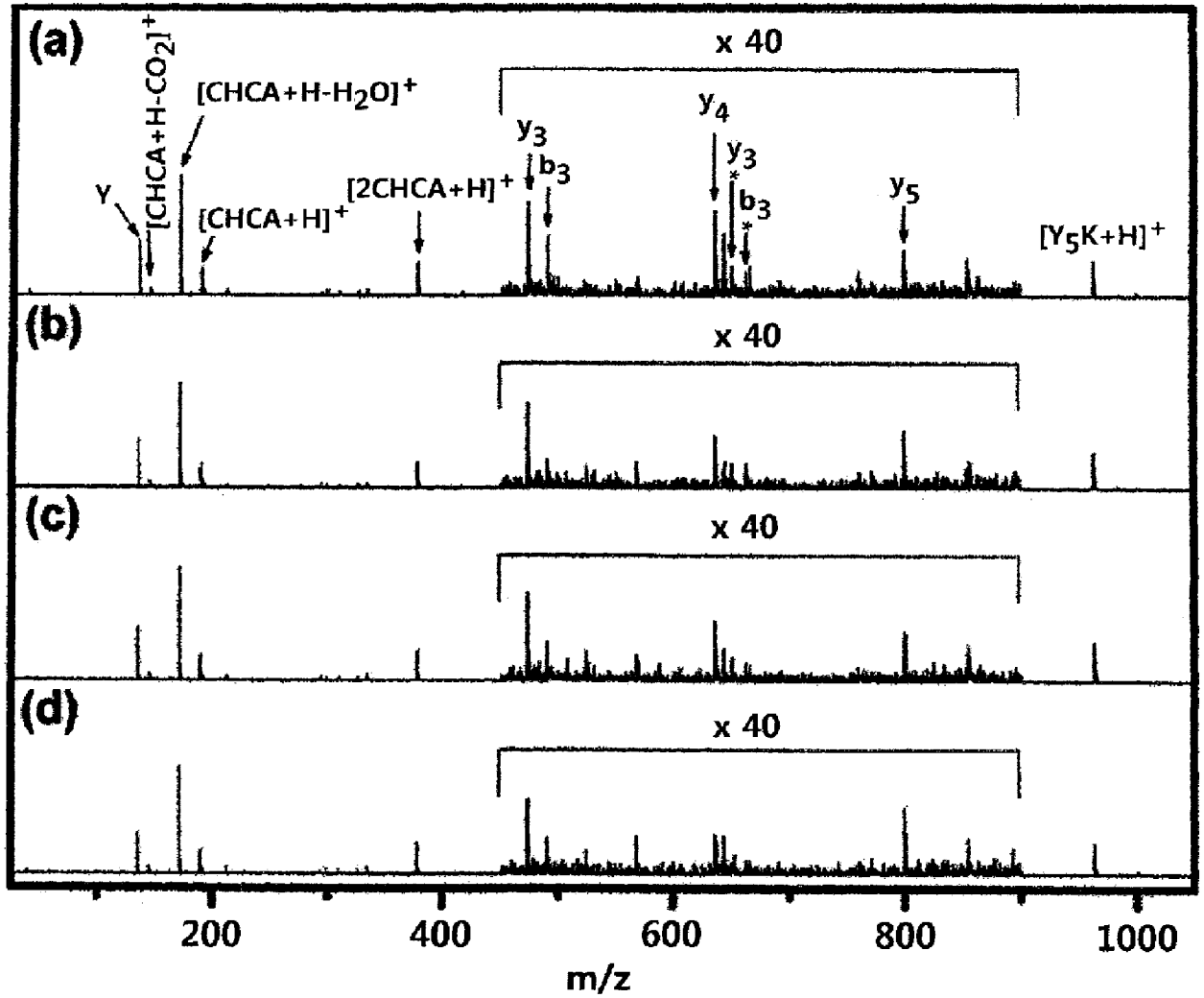
FIG. 4 shows TIC-controlled MALDI spectra taken from one spot on a sample containing 10 pmol of $Y_5K$ in 25 nmol of CHCA using TIC of 900 ions/pulse as the preset value, averaged over the shot number ranges of (a) 31-40, (b) 81-90, (c) 131-140 and (d) 291-300, in Example 4.

The experiment was repeated for a vacuum-dried sample containing 10 pmol of $Y_5K$ in 25 nmol of CHCA, with the feedback adjustment of the laser pulse energy using TIC of 900 ions/pulse as the preset value. The spectra averaged over the shot number ranges of 31-40, 81-90, 131-140 and 241-250 are shown in FIG. 4. The total TICs in these shot number ranges were 9000 (9000), 8600 (53000), 9000 (103000), and 8100 (188000), respectively, with the numbers in parentheses denoting TICs accumulated over the shot number ranges of 31-40, 81-90, 131-140 and 241-250, respectively. The spectral acquisition was terminated at the shot number 250, when the laser pulse energy became three times the threshold energy. As shown in FIG. 4, both the spectral patterns and the ion abundances were similar throughout the measurement on the spot, demonstrating a successful acquisition of reproducible spectra by TIC control.

From the spectral set obtained without TIC control (FIG. 1), the spectra with TIC of 900±180 ions/pulse were selected. The TIC summed over the spectra thus selected was 19,000 ions/pulse. That is, the accumulated TIC in the TIC-controlled spectra, 188,000 ions/pulse, was much larger than that in the TIC-selected spectra, suggesting that TIC control is more efficient than TIC selection in obtaining quantitatively reproducible MALDI spectra. In the above-described method, the pulse energy applied to the sample was adjusted by changing the transmittance of the filter with the output of the nitrogen laser fixed.

Figure 5:
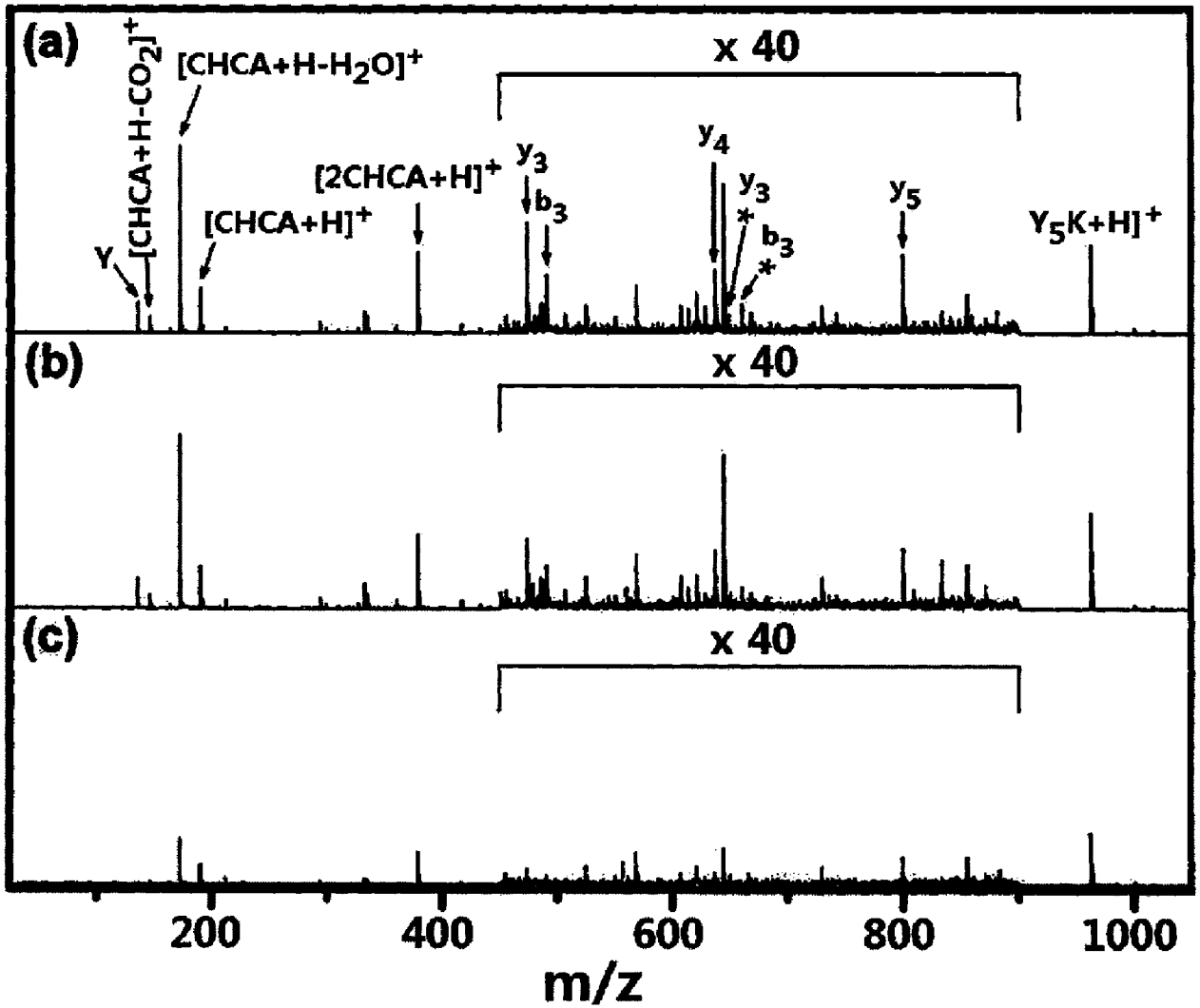
FIG. 5 shows TIC-controlled MALDI spectra taken from one spot on a sample containing 10 pmol of $Y_5K$ in 25 nmol of CHCA using TIC of 2500 ions/pulse as the preset value, averaged over the shot number ranges of (a) 31-40 and (b) 61-70, in Example 4.

In order to investigate whether the output of the laser itself can be adjusted as an alternative to the above method, a 355-nm output from a Nd:YAG (Surelite III-10, Continuum, Santa Clara, Calif., USA) laser was used instead of the nitrogen laser. At the wavelength, the threshold pulse energy was 0.25 μJ/pulse. 2500 ions/pulse was used as the preset value for TIC and spectral data acquisition was started using a laser output corresponding to two times the pulse energy threshold. After acquiring 10 spectra, TIC was calculated and compared with the preset value. The pulse energy was adjusted such that the preset value was restored. Here, the pulse energy was adjusted by changing the delay time for Q-switching. The actual methods for changing the laser output can be different for different lasers. The spectrum of FIG. 5 (*a*) was obtained using the pulse energy corresponding to two times the threshold (shot number range of 31-40). Then, the laser output was adjusted for TIC control. The result obtained in the shot number range of 61-70 is shown in FIG. 5 (*b*). The two spectra look similar, demonstrating a successful reproduction of mass spectra through TIC control via laser output adjustment. For comparison, the result obtained at the same shot number range (61-70) obtained with the laser output fixed at two times the threshold is shown in FIG. 5 (*c*). It can be seen that quantitatively reproducible spectra can be generated by the adjustment of laser output as was the case of the pulse energy adjustment using the filter with the laser output fixed.

Figure 6A:
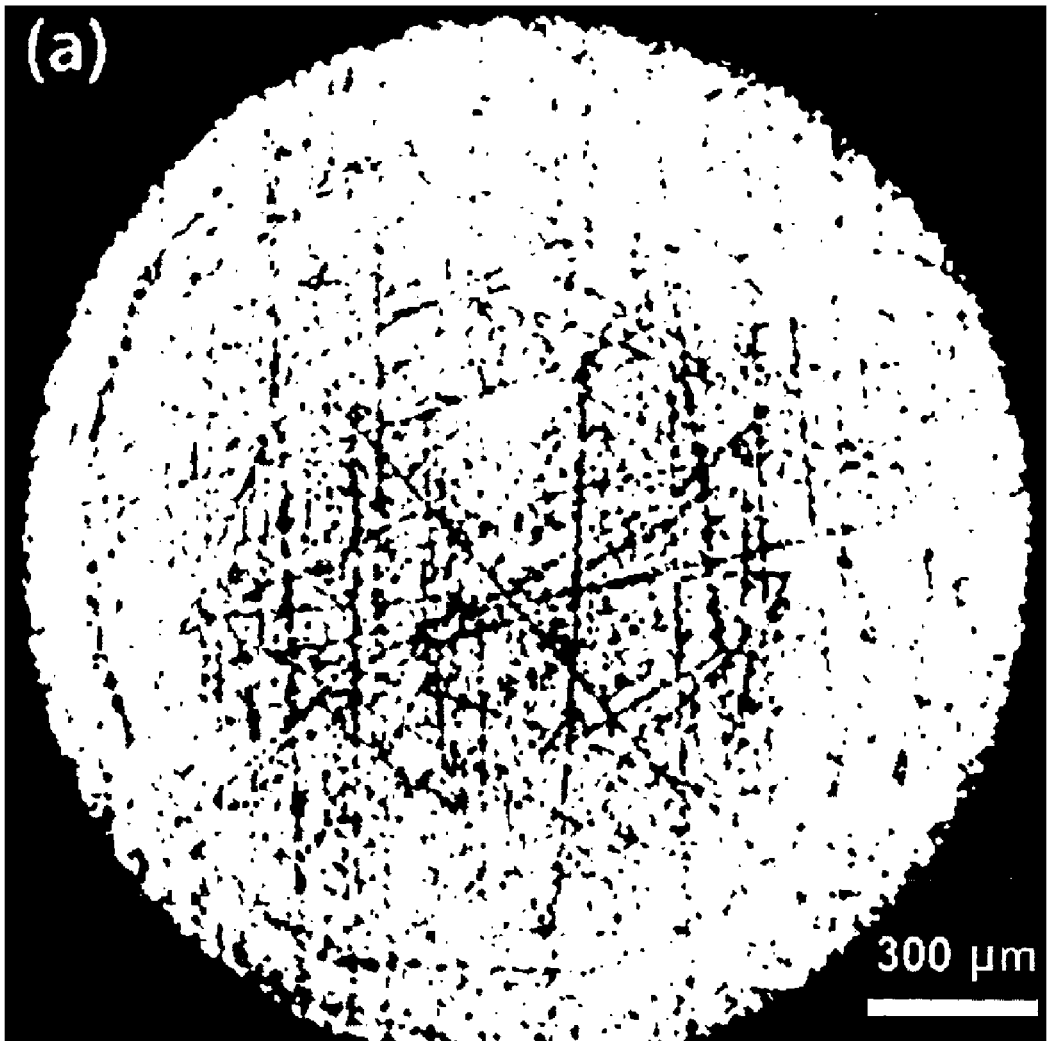
FIGS. 6*a*-6*c* show photographs of samples containing 10 pmol of $Y_5K$ in 25 nmol of CHCA prepared by (a) vacuum drying and (b) air drying and (c) a sample containing 20 pmol of $Y_6$ in 100 nmol of DHB, in Example 4.

A sample prepared by vacuum drying of a peptide/CHCA solution is relatively homogeneous. The photograph of a vacuum-dried sample is shown in FIG. 6*a*. To check the spot-to-spot reproducibility of the sample, TIC-controlled spectra were acquired from many spots on a vacuum-dried peptide/CHCA sample. The obtained spectra were similar independent of the spots chosen for laser irradiation. Without TIC control, checking the spot-to-spot variation was meaningless because even the spectra obtained at the same spot were not reproducible.

When a solution with a given composition is loaded on the target and dried, the initial thickness of the solid sample will be affected by the volume of the solution loaded and by the diameter of the sample. This will affect $T_{early}$, which, in turn, will cause sample-to-sample irreproducibility in MALDI spectra. It looks obvious that such a problem can be handled easily because maintaining $T_{early}$ near the preset value is a main strategy. To check this, a sample was prepared using the same solution as was used to obtain the spectra of FIG. 4, but 2.0 μL of the solution was loaded on the target instead of 1.0 μL. The measurement showed that doubling the volume of the solution increased the sample thickness by around 40%. TIC-controlled spectra were obtained from this sample using the same preset value (i.e., 900 ions/pulse). The patterns of the spectra were similar to those in FIG. 4, indicating that TIC control can reduce the errors caused at the time of sample loading.

Figure 6B:
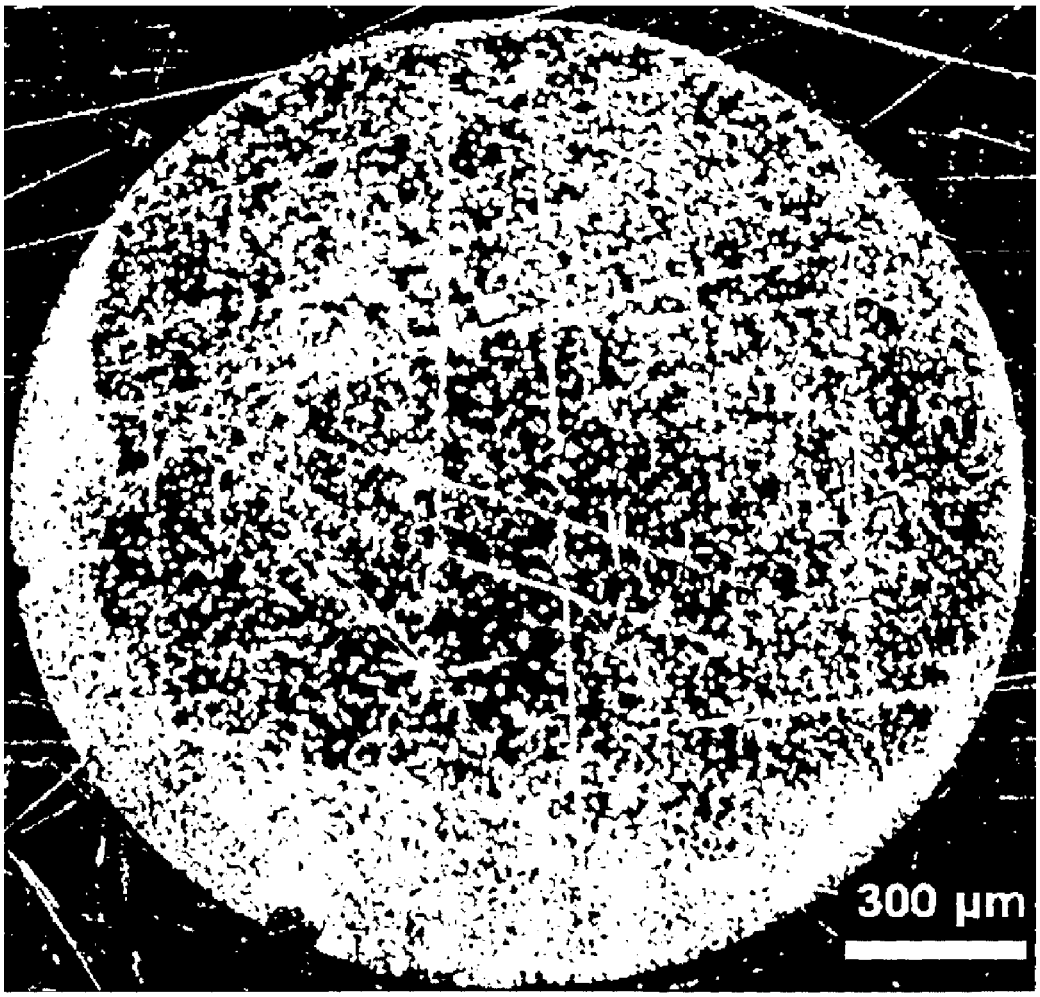
Figure 6C:
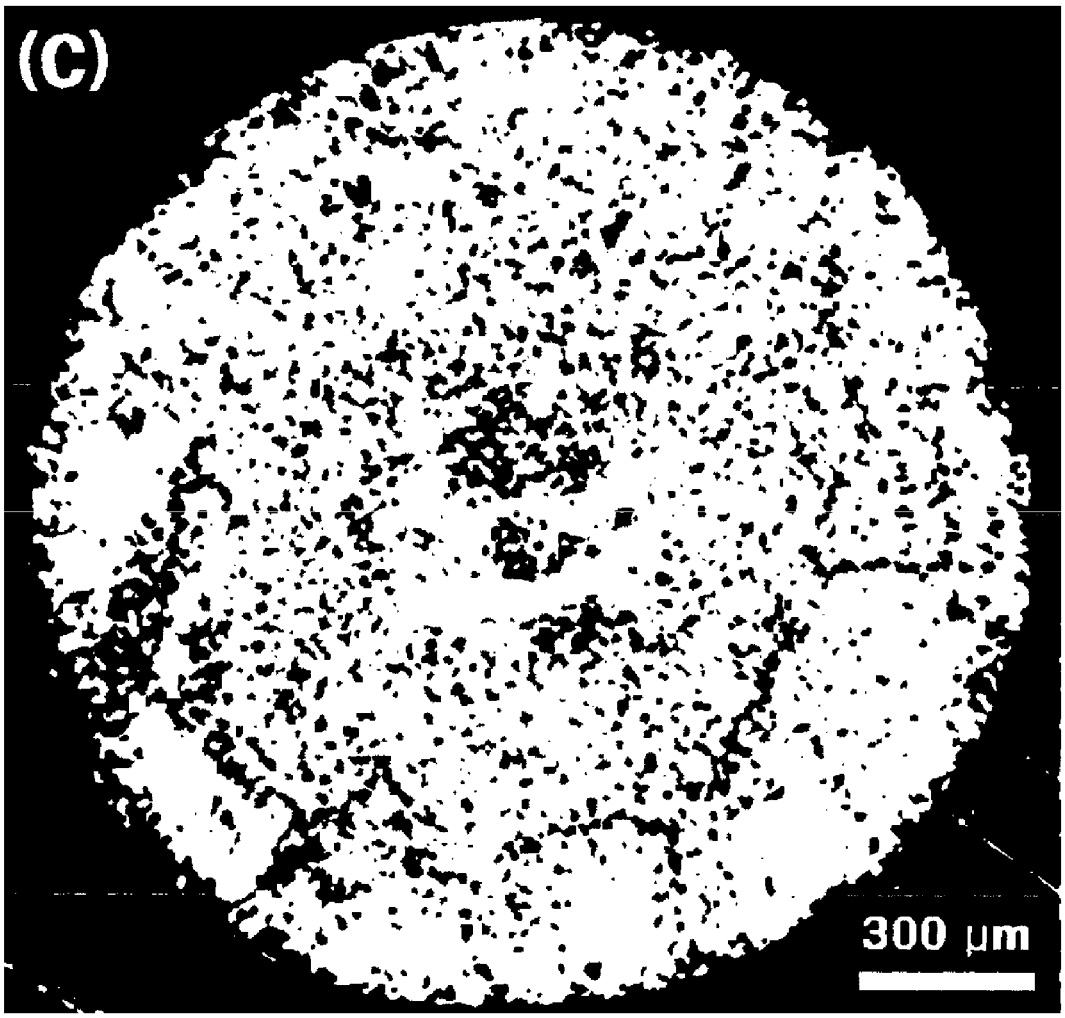
Figure 7:
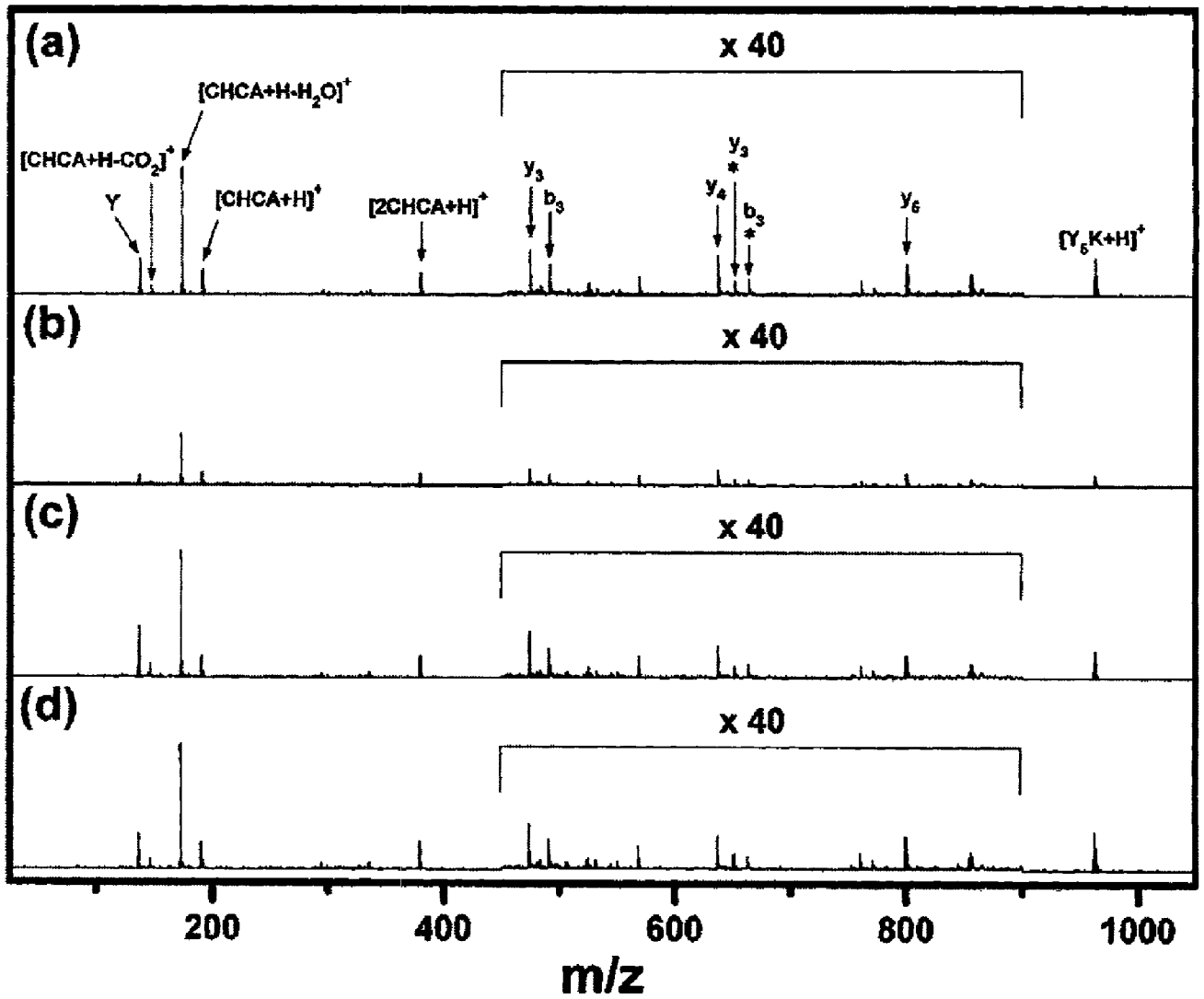
FIG. 7 shows (a), (b) MALDI spectra of an air-dried sample containing 10 pmol of $Y_5K$ in 25 nmol of CHCA taken without TIC control and (c), (d) TIC-controlled MALDI spectra of the same sample taken using the preset value of 900 ions/pulse, in Example 4.

The samples prepared by air drying a peptide/CHCA solution were not homogeneous. The photograph of an air-dried sample is shown in FIG. 6*b*. Matrix crystallites are present as islands (FIG. 6*b*), whereas those in a vacuum-dried sample form a rather continuous film (FIG. 6*a*). To see the limitation to the spectral reproducibility imposed by sample inhomogeneity, samples containing 10 pmol of Y5K in 25 nmol of CHCA were prepared by air drying the same solution used to obtain the spectra in FIG. 4. MALDI spectra taken from air-dried samples, without TIC control and averaged over each spot, displayed a significant spot-to-spot fluctuation, as demonstrated by the two typical spectra shown in FIGS. 7 (*a*) and (*b*). This may be partly because the number of crystallites on a laser focal spot of the air-dried sample fluctuates between 3 and 5.

Next, a similar experiment was performed with TIC control. As demonstrated by two typical spectra shown in FIGS. 7 (*c*) and (*d*), the MALDI spectra obtained from different spots had become quantitatively similar (i.e., similar both in pattern and in absolute abundance of each ion, upon TIC control). Also, remarkable is the fact that the TIC-controlled, spot-averaged spectra for air-dried samples in FIGS. 7 (*c*) and (*d*) look rather similar to the TIC-controlled spectra for the vacuum-dried sample in FIG. 4. Upon a closer look, it can be seen that the $T_{early}$ associated with the spectra obtained from air-dried samples tends to be slightly higher than that from the vacuum-dried sample even though the same preset value of TIC was used in both cases. For example, the $[CHCA+H-CO_2]^+$-to-$[CHCA+H]^+$ ratio is a little larger for the air-dried samples than for the vacuum-dried one. A plausible explanation for the above difference is as follows. To generate the same numbers of ions from the two different samples, $T_{early}$ for the air-dried sample should be a little higher than that for the vacuum-dried one because the sample area exposed to laser irradiation is smaller for the former sample. Regardless, it is remarkable to note that the spectra obtained from the two samples with significantly different morphology have become similar upon TIC control.

Figure 3B:
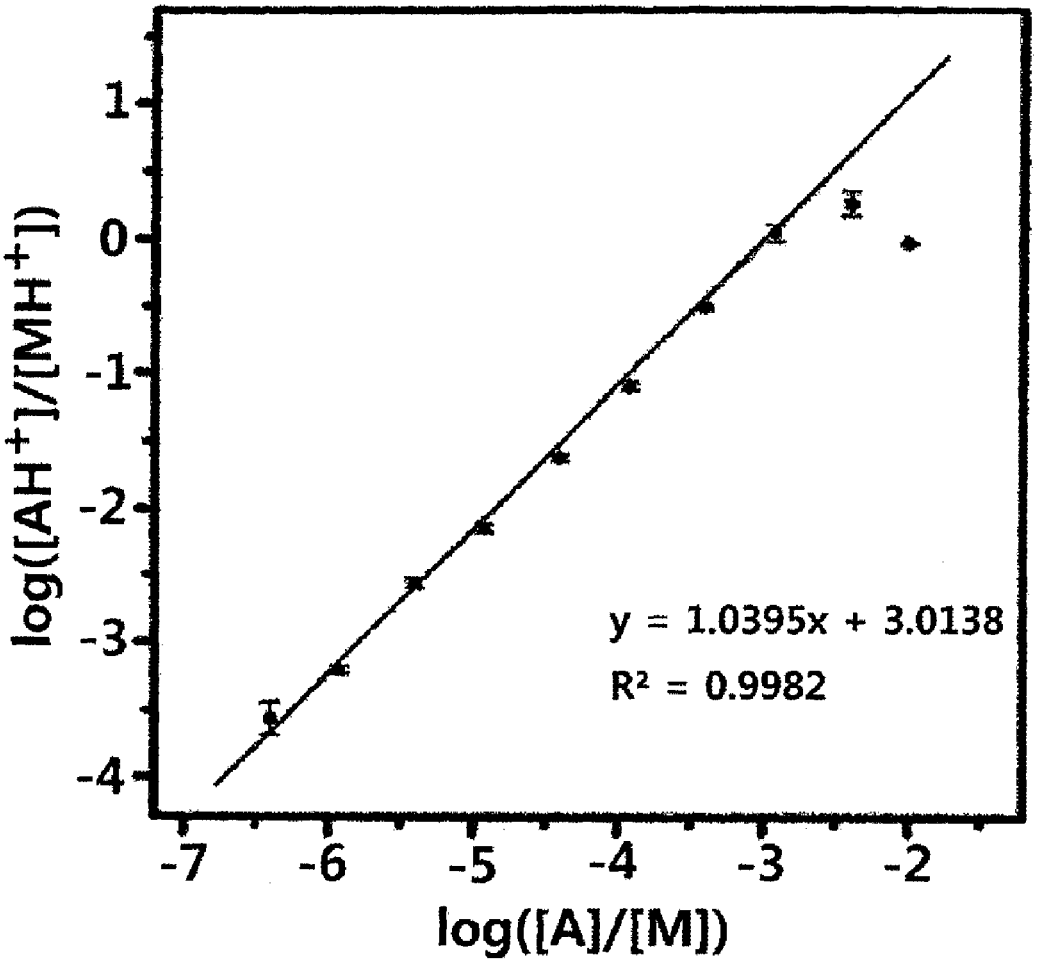

An $[AH^+]/[MH^+]$ vs. [A]/[M] plot was obtained for vacuum-dried samples containing 0.01-250 pmol of $Y_5K$ in 25 nmol of CHCA, with TIC control using TIC of 900 ions/pulse as the preset value. The obtained calibration curve is shown in FIG. 3*b*. The calibration curve shows excellent linearity.

Also as in CHCA-MALDI, the total number of ions generated by a laser pulse in DHB-MALDI was virtually the same regardless of the identities, concentrations, and number of analytes in a solid sample as long as $T_{early}$ was the same. The TIC data calculated from the same spectra are listed in Table 2, which suggest that TIC can be used as a measure of $T_{early}$ in DHB-MALDI, too.

TABLE 2

DHB- TIC versus analyte concentration in DHB-MALDI

| Analyte | Analyte concentration (pmol)[a] | TIC per laser pulse[b] $T_{early}$ = 780 ± 5K | TIC per laser pulse[b] $T_{early}$ = 800 ± 5K |
|---|---|---|---|
| —[c] | 0 | 480 ± 40 | 1510 ± 150 |
| $Y_6$ | 2.0 | 430 ± 70 | 1310 ± 60 |
| $Y_6$ | 20 | 460 ± 60 | 1400 ± 130 |
| Mixture[d] | 2.0/analyte | 500 ± 100 | 1300 ± 110 |

[a]Picomoles (pmol) of analyte in 100 nmol of DHB in solid sample.
[b]Averages over three or more measurements with one standard deviation.
[c]Pure DHB.
[d]0.1 pmol each of $Y_5K$, $Y_5R$, YLYEIAR, YGGFL, creatinine and histamine in 100 nmol of DHB.

Figure 3C:
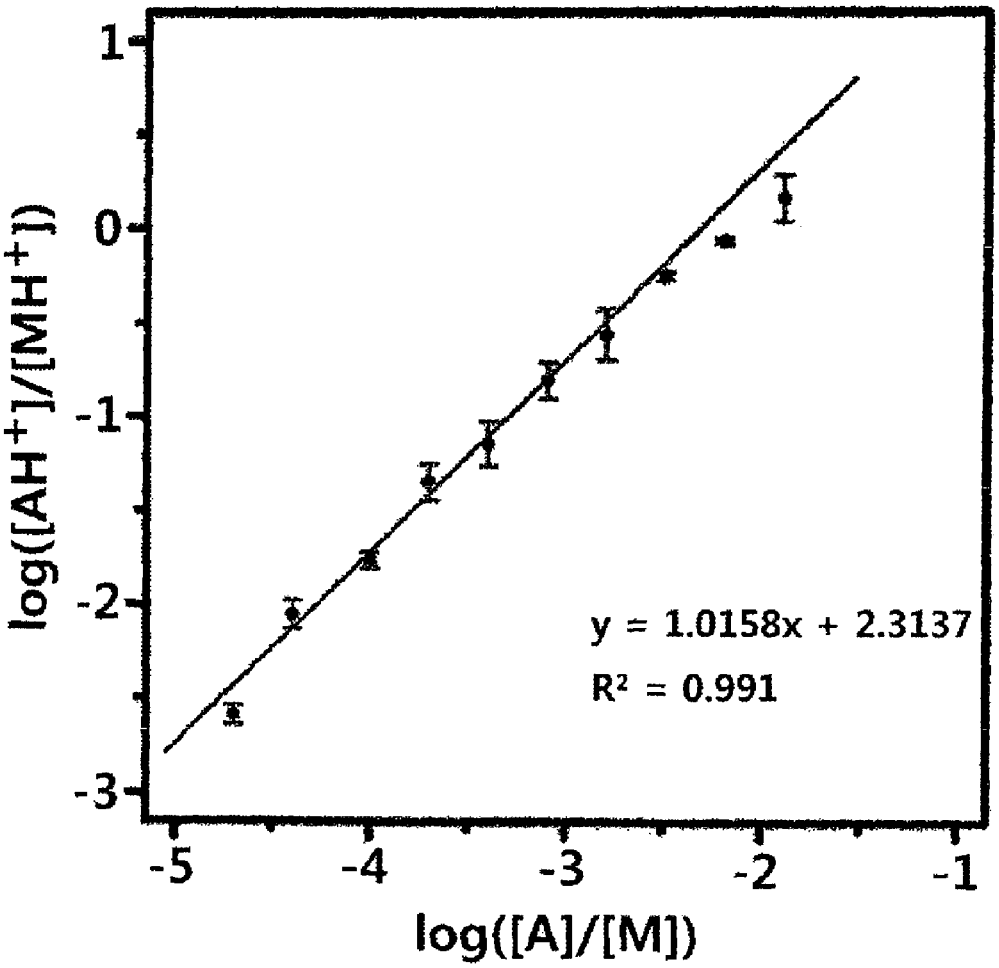

A set of TIC-controlled MALDI spectra was obtained by repetitive irradiation to one spot on a sample containing 20 pmol of $Y_6$ in 100 nmol of DHB, using TIC of 1300 ions/pulse as the preset value. Both the spectral patterns and ion abundances were similar throughout the measurement on the spot, as in CHCA-MALDI. Also, a calibration curve was obtained for a sample containing 1.0-640 pmol of $Y_6$ in 100 nmol of DHB. The excellent linearity of the curve shown in FIG. 3*c* demonstrates the utility of TIC control in quantitative analysis using DHB-MALDI.

Example 5

Quantitative Analysis of Low-Concentration Samples

CHCA, DHB and SA (sinapinic acid), as matrices, and creatinine and sucrose, as analytes, were purchased (Sigma, St. Louis, Mo., USA). Also, $Y_5K$, $Y_5R$ and DRVYIHPF (angiotensin II) were purchased as peptides (Peptron, Daejeon, Korea). Solid samples containing the matrices were prepared by two different methods, vacuum-dried and then microspotted. For the vacuum drying, a 25% acetonitrile aqueous solution was used as a solvent for the solution samples. In preparation of CHCA and SA samples by microspotting, a 80% ethanol aqueous solution was used as a solvent and 15% methanol was used for DHB (dihydroxybenzoic acid). The vacuum drying was performed after loading 1 μL of the CHCA, DHB and SA solutions on a stainless steel target. For the microspotting, a microspotter (μMatrix Spotter, ASTA, Suwon, Korea) in the form of a modified inkjet printer was used. The matrices spotted on the sample plate were eluted using a solvent and then quantitated by UV absorption spectroscopy.

Some preliminary measurements were made on the microspotted solid samples with a diameter of about 2 mm before spectral acquisition. First, threshold pulse energy was measured for MALDI using each matrix. The threshold pulse energy for CHCA, DHB and SA was 0.4 μJ/pulse, 1.0 μJ/pulse and 0.6 μJ/pulse, respectively. To determine the preset value for TIC, spectra were obtained for fresh samples at two times the threshold pulse energy and the total ion count (TIC) reaching the detector per laser pulse was determined. For the pure matrices, the TIC includes the signals of matrix-derived particles. And, for the peptide-containing samples, the TIC includes the signals of peptide-derived particles. TIC was calculated from each of the acquired spectra, and the laser pulse energy was adjusted such that the TIC was maintained within 20% of the preset value. In MALDI using CHCA, DHB and SA, preset values of 900 ions/pulse, 1200 ions/pulse and 1200 ions/pulse were used, respectively. If the matrix suppression is not serious, the number of the peptide ions is determined not by the amount of the peptide itself but by the peptide-to-matrix ratio in the solid sample. Accordingly, for comparison of different sample preparation methods, spectra have to be obtained from the samples having the same peptide-to-matrix ratio. In this example, the amount of the matrix was optimized and 200 single-shot spectra were obtained from each laser-irradiated spot using the present TIC described above. The concentration of each of CHCA, DHB and SA solutions injected into the spotter cartridge was 80 nmol/μL, 100 nmol/μL and 50 nmol/μL, respectively. When the target was coated once, CHCA, DHB and SA were deposited with surface areas of 0.27 nmol/mm2, 0.89 nmol/mm2 and 0.17 nmol/mm2, respectively. For CHCA, when the target was coated 30 times, 8.0 nmol/mm2 was deposited. For DHB, 22 nmol/mm2 was deposited after 25 times of coating. And, for SA, 16 nmol/mm2 was deposited after 95 times of coating. The amount of the matrix on the 2-μm spot solid sample was 25 nmol, 70 nmol and 50 nmol, respectively, for CHCA, DHB and SA. 2-μm and 200-nm samples were prepared in the same manner. 1 μL of a solution containing each of 25 nmol of CHCA, 70 nmol of DHB and 50 nmol of SA was loaded on the stainless steel target and vacuum-dried. As a result, solid samples with a diameter of ~2 nm were prepared. The resulting three samples having the same matrix, e.g., the microspotted 2-μm and 200-nm CHCA samples and the vacuum-deposited 2-μm CHCA sample, had almost the same thickness.

Figure 8A:
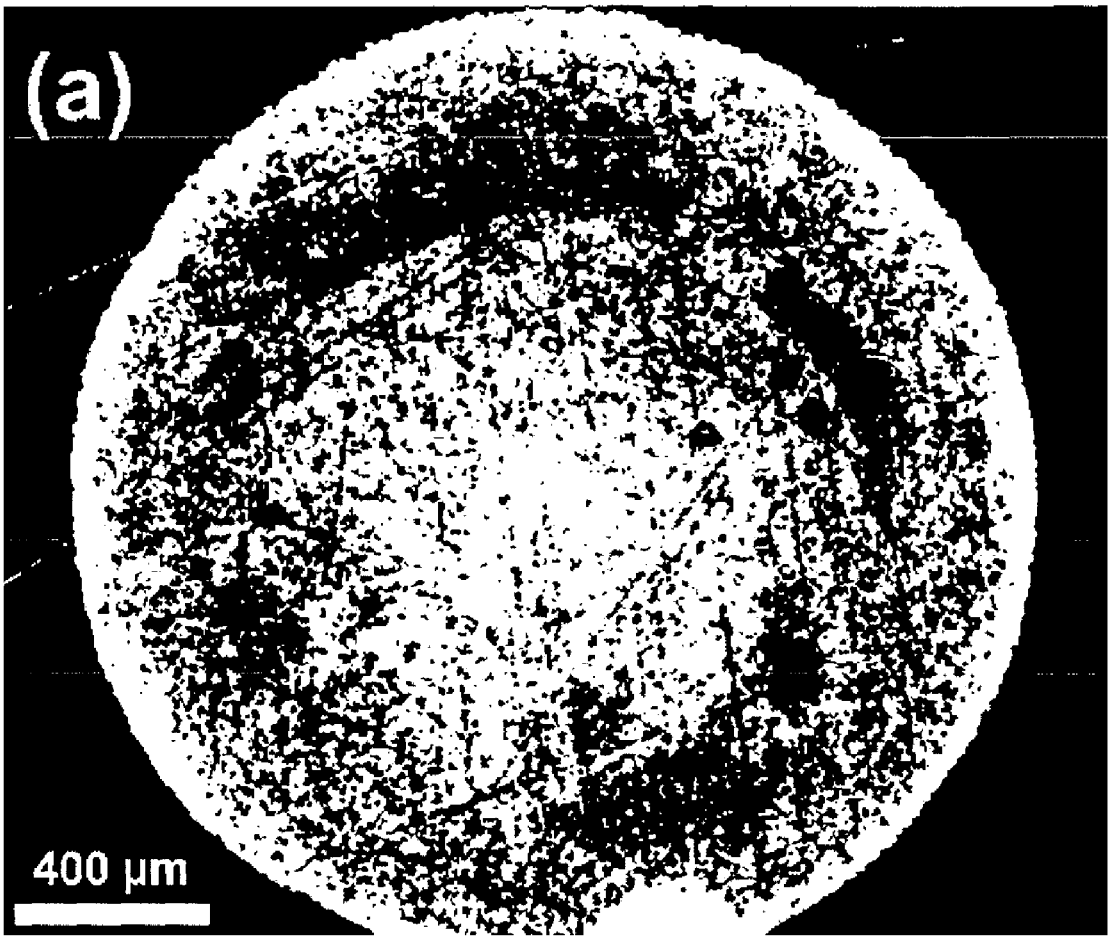
FIGS. 8*a*-8*i* show microscopic images of vacuum-dried solid samples of (a) CHCA, (b) DHB and (c) SA with a diameter of 2 mm, microscopic images of microspotted solid samples of (d) CHCA, (e) DHB and (f) SA with a diameter of 2 mm, and microscopic images of microspotted solid samples of (g) CHCA, (h) DHB and (i) SA with a diameter of 200 μm.
Figure 8B:
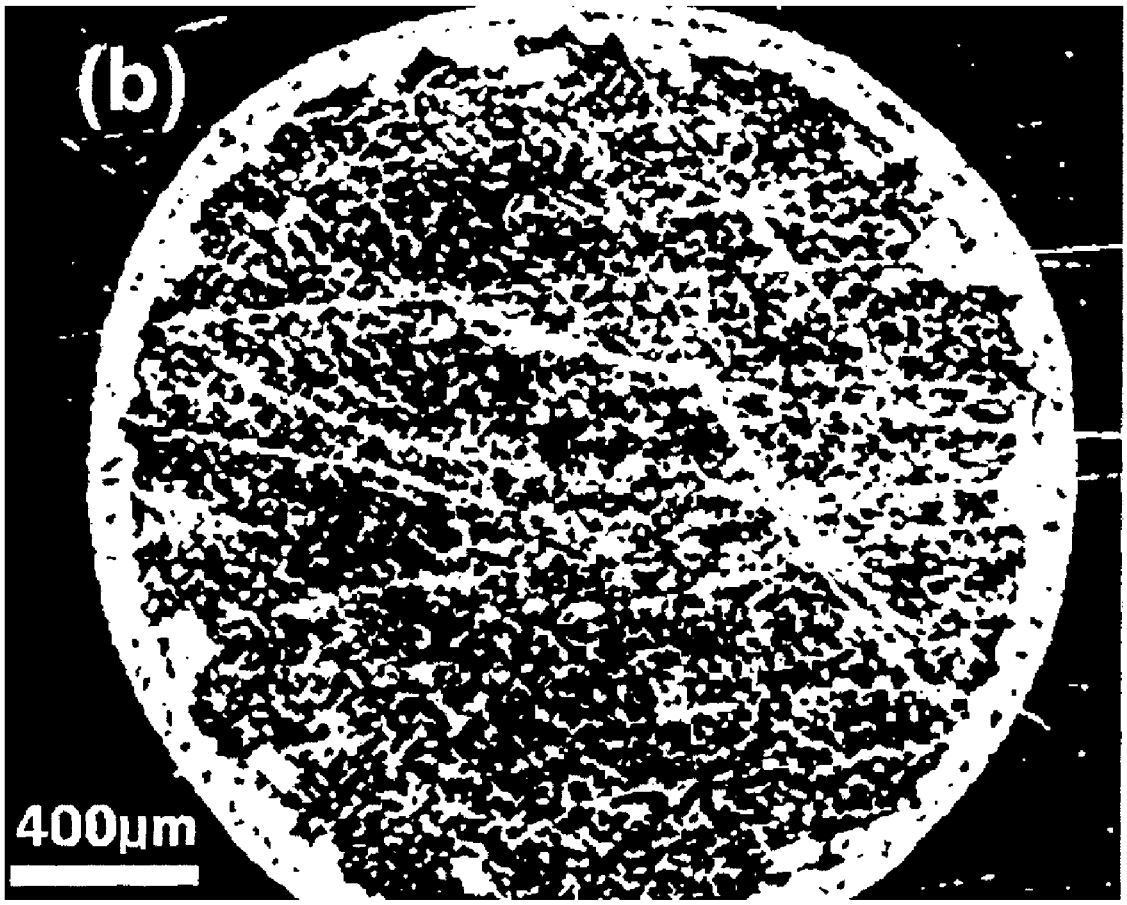
Figure 8C:
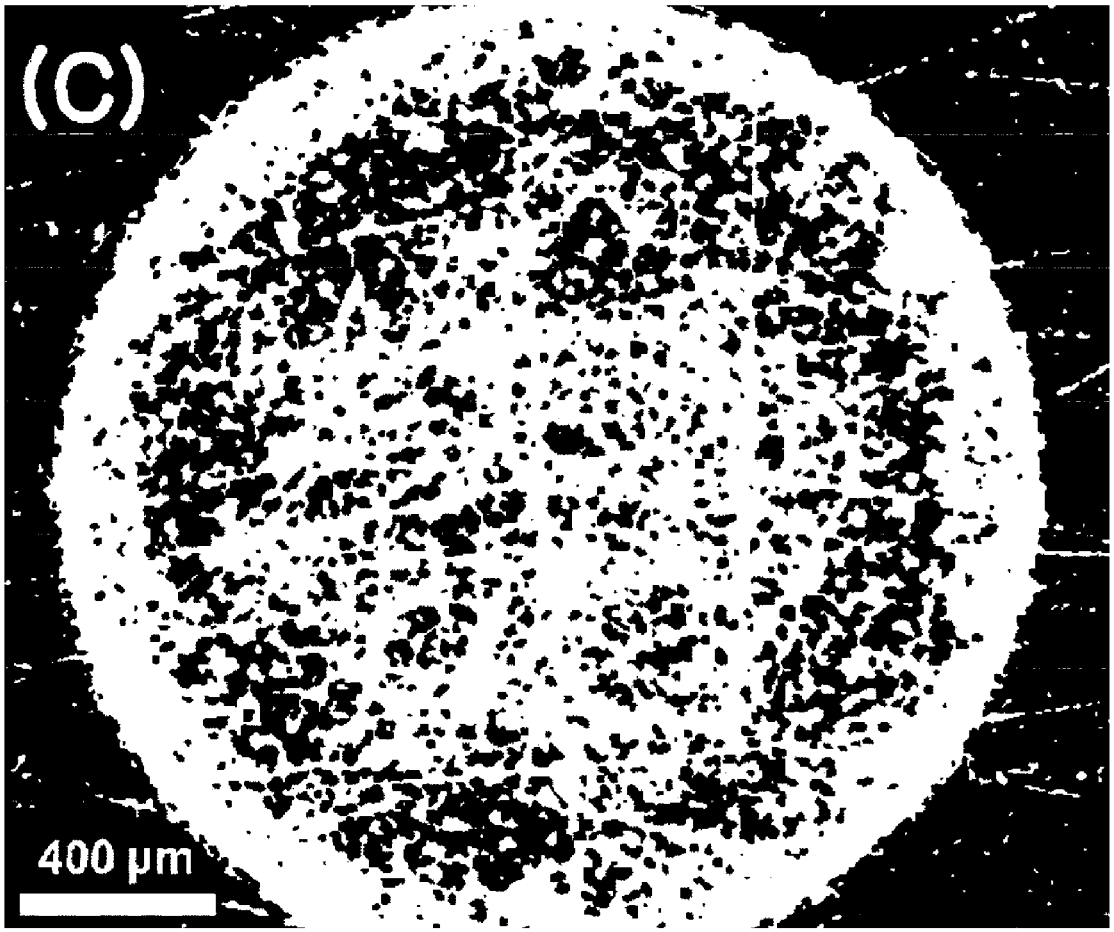
Figure 8D:
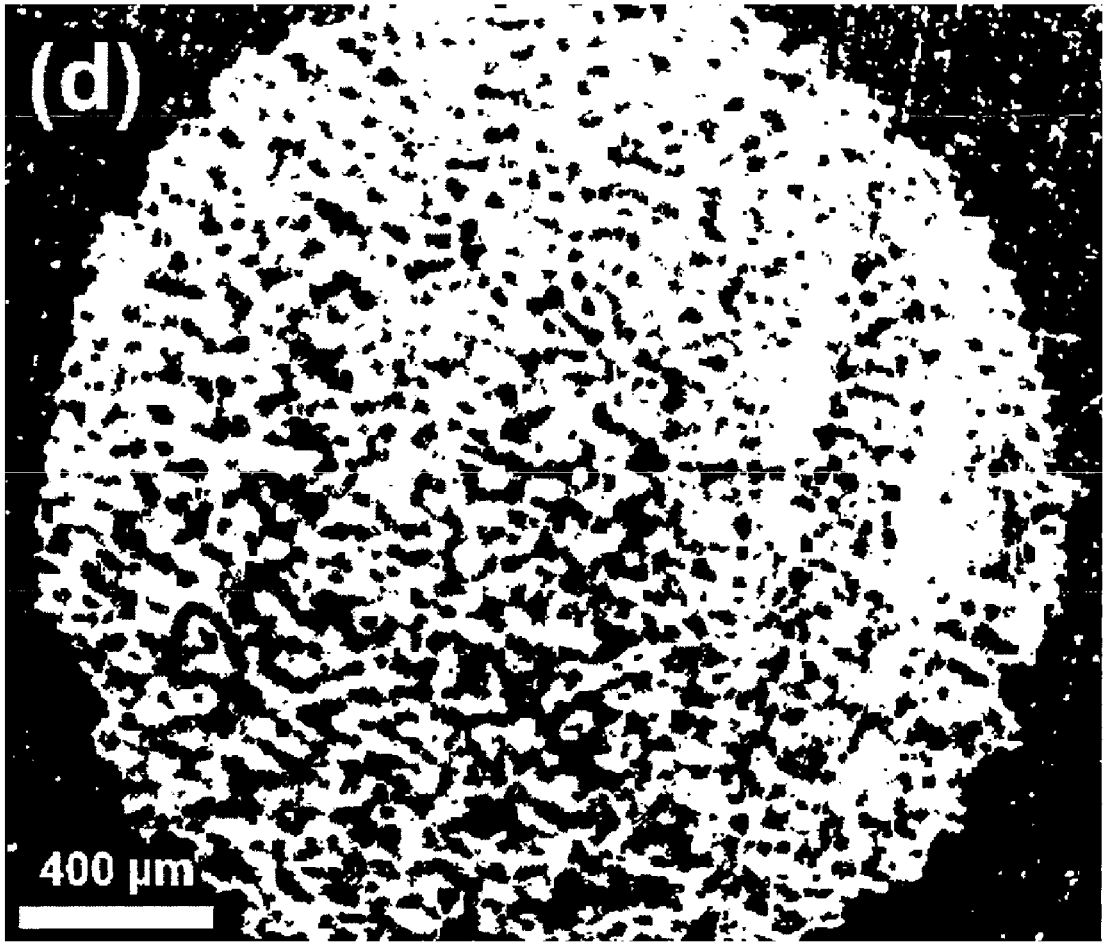
Figure 8E:
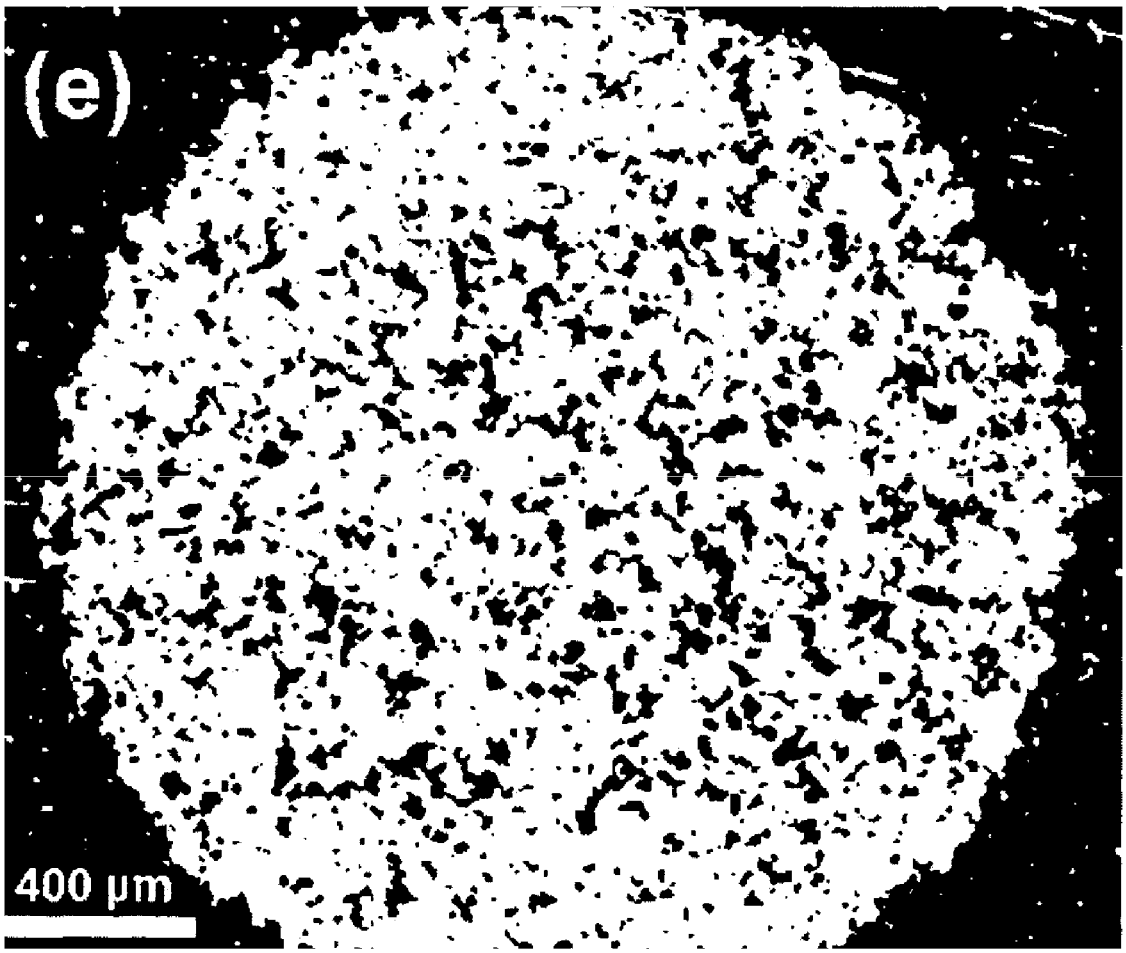
Figure 8F:
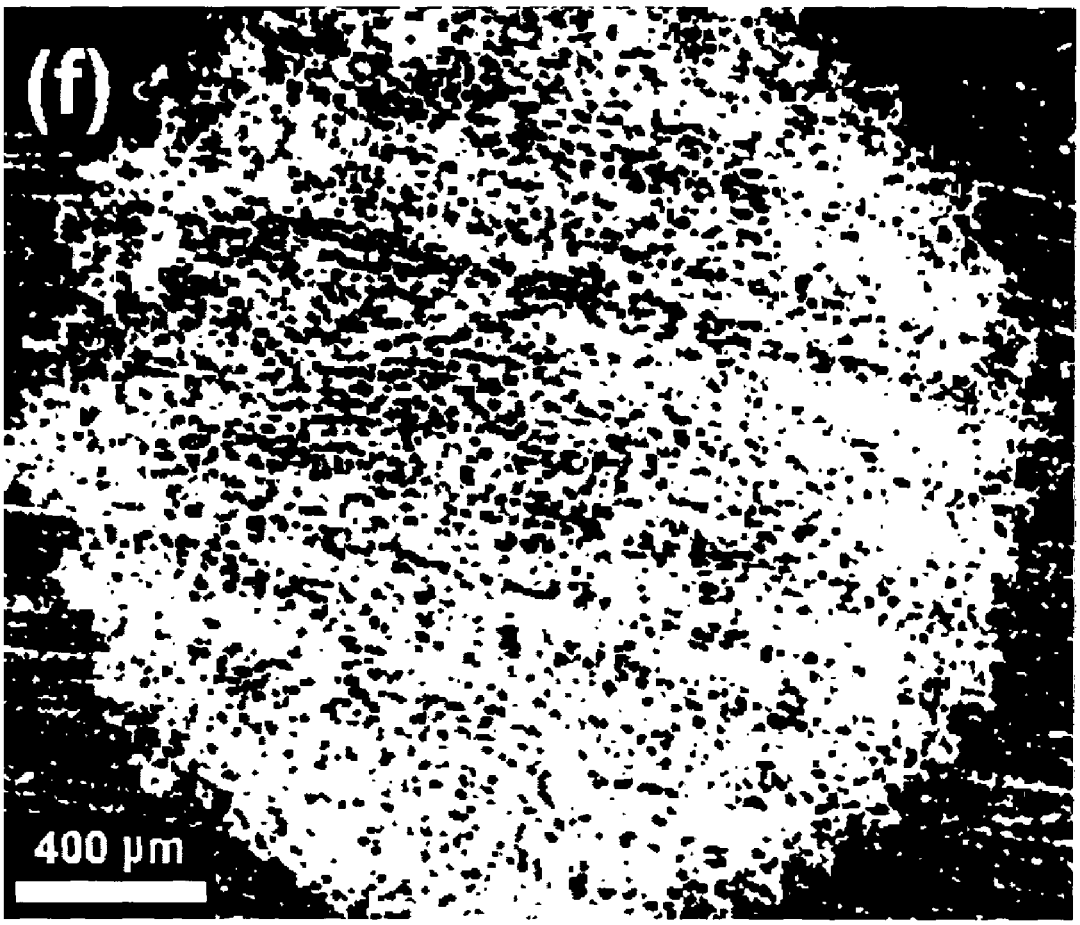
Figure 8G:
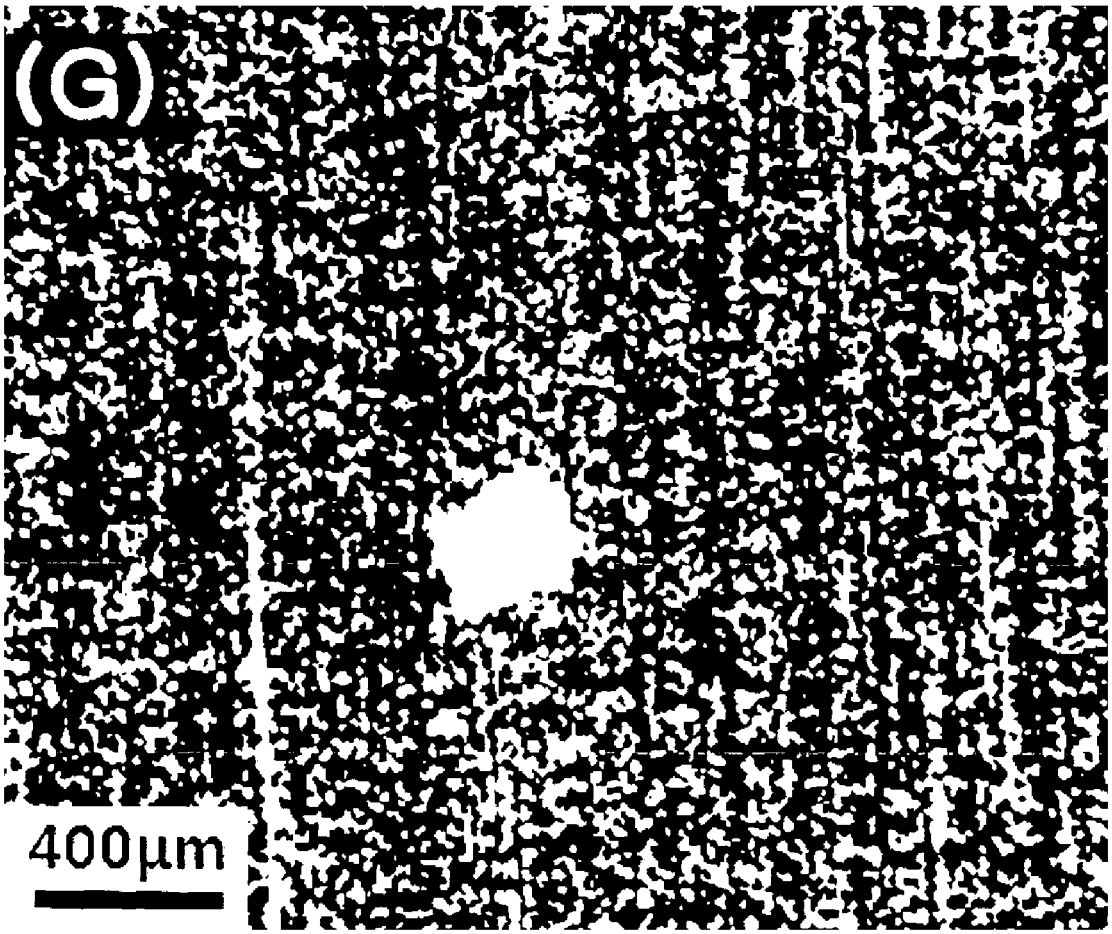
Figure 8H:
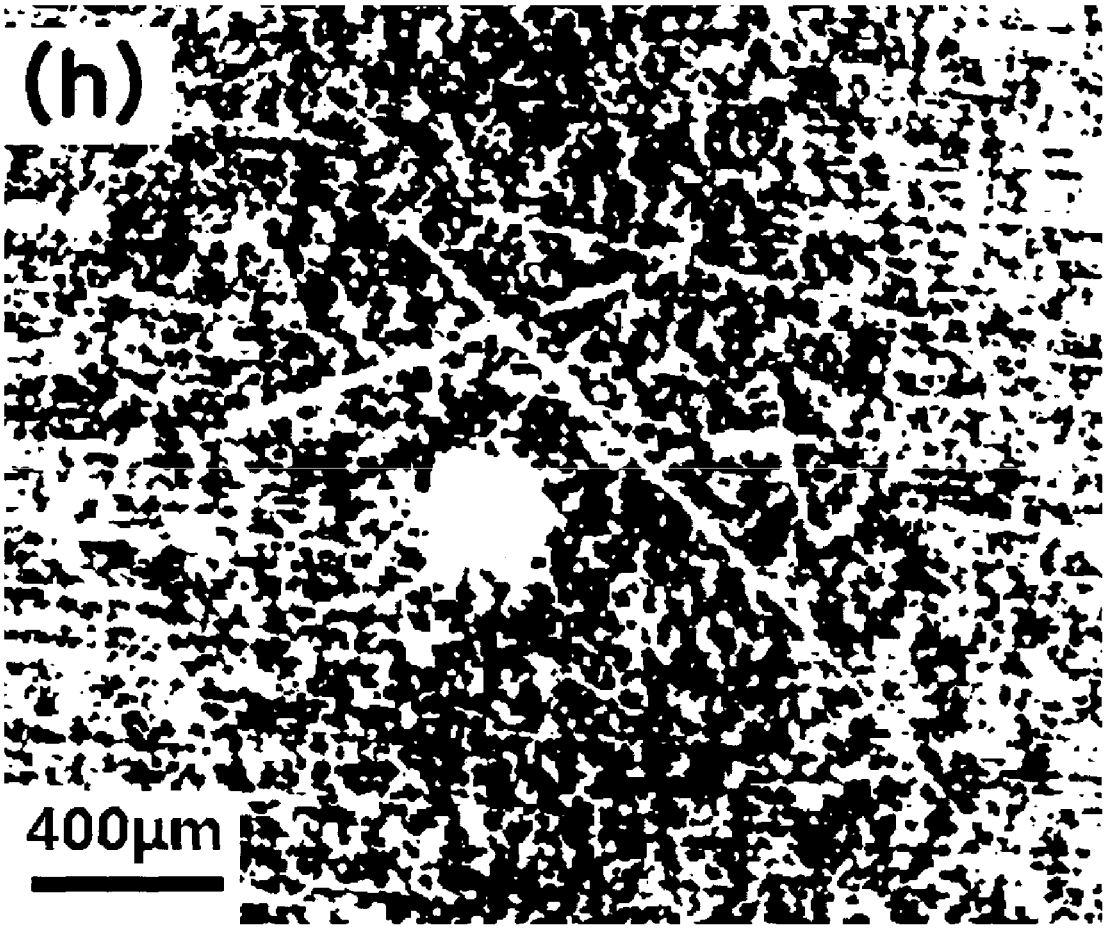
Figure 8I:
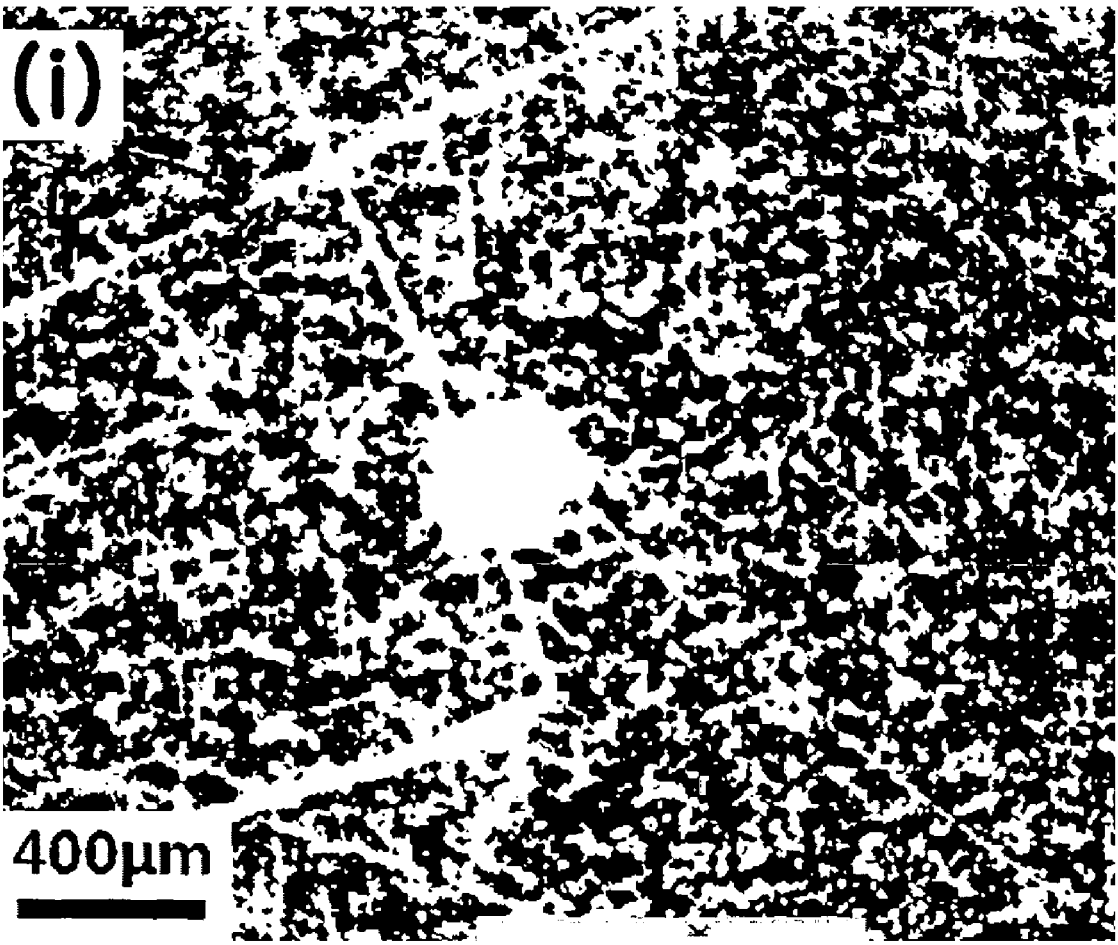

The microscopic images of the vacuum-dried CHCA, DHB and SA solid samples are shown in FIGS. 8*a*, 8*b* and 8*c*, respectively. The vacuum-dried CHCA sample looks rather homogeneous. In contrast, the DHB and SA samples are quite inhomogeneous with rings in the periphery. The air-dried samples were much more inhomogeneous (not shown). Three matrix samples of similar size were prepared by microspotting, too. The microscopic images of the prepared CHCA, DHB and SA samples are shown in FIGS. 8*d*, 8*e* and 8*f*, respectively. When compared with the vacuum-dried DHB and SA samples, the microspotted samples were much more homogeneous. The microspotted samples, particularly the DBB sample, were not so much homogenous as the vacuum-dried CHCA sample. Also, CHCA, DHB and SA solid samples with a diameter of 200 μm were prepared by microspotting. Their microscopic images are shown in FIGS. 8*g*, 8*h* and 8*i*, respectively. All of the samples look quite homogeneous. Since the two (2 mm and 200 μm) microspotted samples of a given matrix have the same effective thickness, it is expected that the amount of the matrix in the sample is proportional to the surface area. As confirmed through experiment, the amount of CHCA, DHB and SA in the 200-μm samples was 250 pmol, 700 pmol and 500 pmol, respectively.

Figure 9:
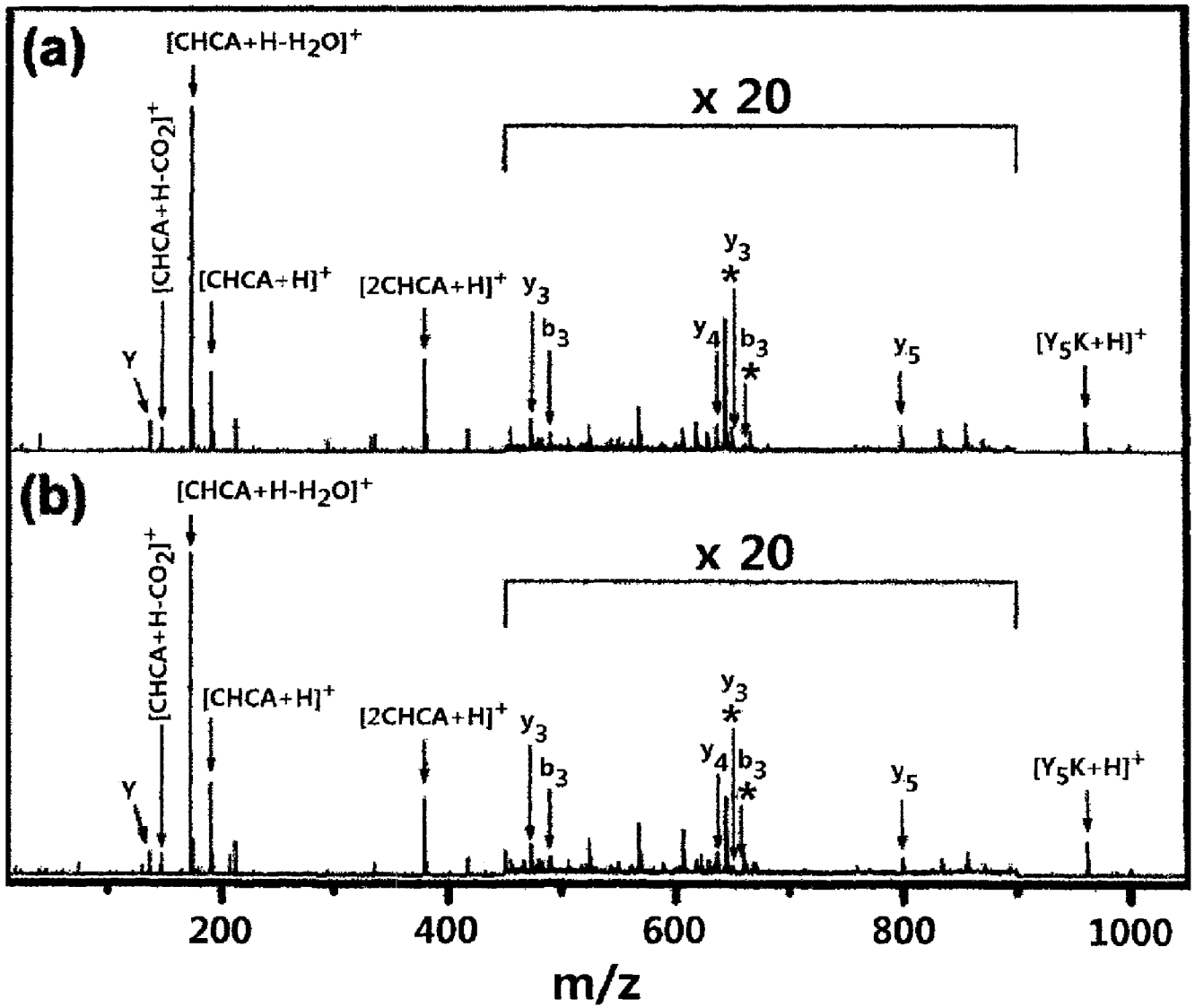
FIG. 9 shows MALDI spectra of (a) a vacuum-dried sample containing 3 pmol of $Y_5K$ in 25 nmol of CHCA and (b) a 200-μm microspotted sample containing 30 fmol of $Y_5K$ in 250 pmol of CHCA.

The CHCA-MALDI spectrum of a vacuum-dried sample containing Y5K (3.0 pmol of $Y_5K$ in 25 nmol of CHCA) with TIC control is shown in FIG. 9 (*a*). $[CHCA+H]^+$, $[CHCA+H-H_2O]^+$ and $[2CHCA+H]^+$ are major matrix-derived ions. As seen from the spectrum, these peptide ions are accompanied by in- and post-source decay products. The immonium Y was the most predominant in-source decay product among the peptide ions.

In addition, 2-μm and 200-μm samples having the same $Y_5K$-to-CHCA ratio and having the same thickness were prepared by microspotting. Because the MALDI spectra of these samples were essentially the same, only the spectrum obtained from the 200-μm sample is shown in FIG. 9 (*b*). The spectrum is very similar to the spectrum obtained from the vacuum-dried sample (FIG. 9 (*a*)) not only in pattern but also in the number of corresponding ions. That is to say, the MALDI spectra of homogenous samples having a given composition obtained with the same TIC are identical regardless of the solid sample preparation method and the thickness thereof.

It was observed that, for DHB-MALDI of the vacuum-dried peptide samples, the spectrum obtained from the peripheral ring is slightly different from the spectrum obtained from the center. In particular, the $I([P+H]^+)/I([M+H]^+)$ ratio was different. Accordingly, slightly different calibration curves were obtained depending on the spots where measurement was made. In contrast, from the samples prepared by microspotting, reproducible spectra were obtained regardless of the spot position. In case of the 2-μm samples prepared by microspotting, spectral acquisition under TIC control was often disturbed by voids in the samples. This inconvenience was hardly observed in DHB-MALDI of the 200-μm samples. In SA-MALDI, a little spot dependence was observed for the vacuum-dried samples, which almost disappeared in the microspotted samples.

Figure 10:
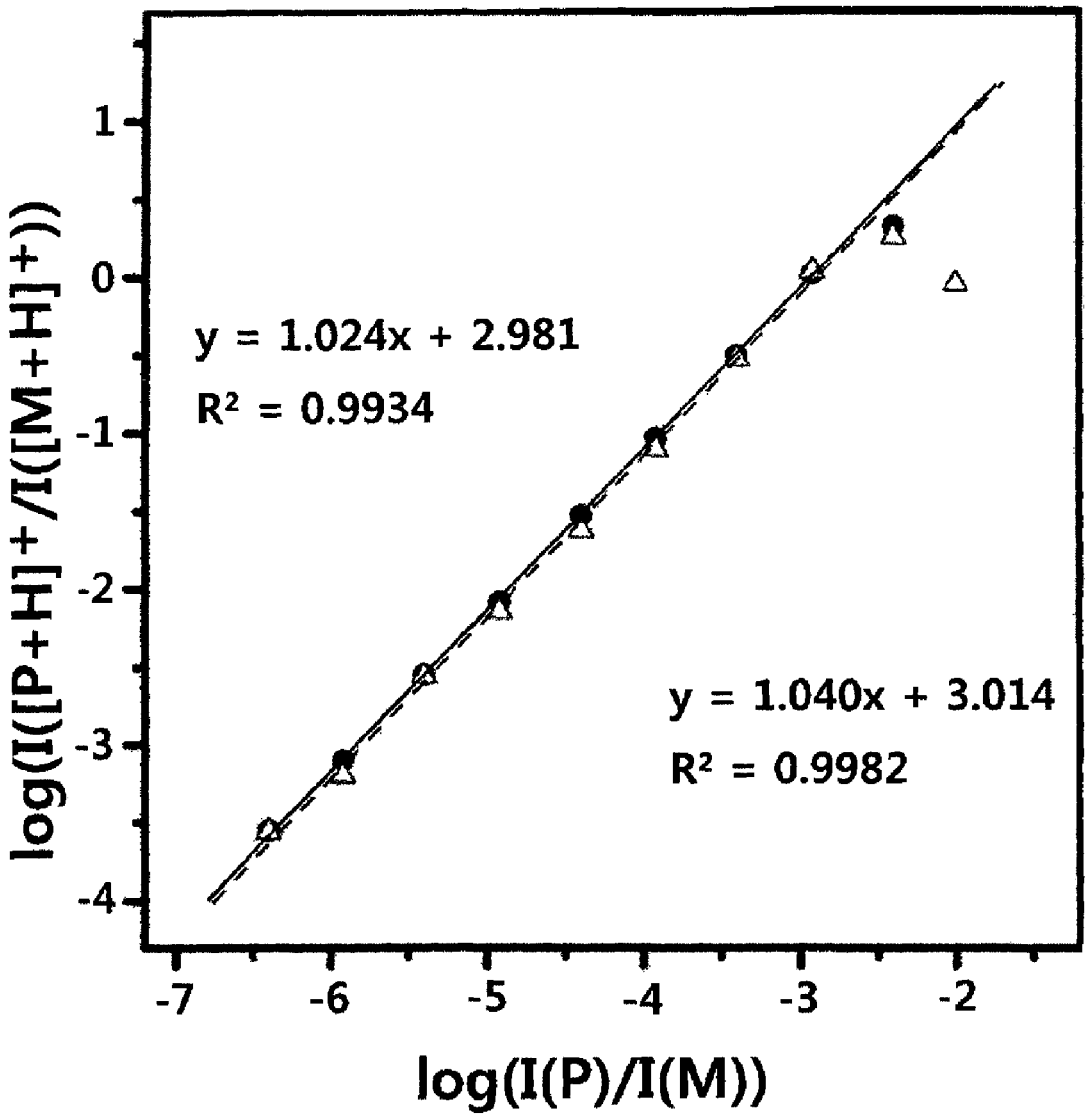
FIG. 10 shows calibration curves obtained for a vacuum-dried sample containing 0.01-250 pmol of $Y_5K$ in 25 nmol of CHCA (a dashed line with triangles, y=1.040x+3.014) and a 200-μm microspotted sample containing 0.1-1000 fmol of $Y_5K$ in 250 pmol of CHCA (a solid line with filled circles, y=1.024x+2.981).

One of the good methods for testing the homogeneity of microspotted samples is to obtain calibration curves and check their linearity. FIG. 10 shows a calibration curve obtained for samples containing 0.01-250 pmol of $Y_5K$ in 25 nmol of CHCA under TIC of 900±180 counts/pulse (corresponding to the peptide-to-matrix ratio of 1/2500000-1/100). In the log-log plots, the slope 1.040 is close to 1 and corresponds to the ratio of $I([P+H]^+)/I([M+H]^+)$ and I(P)/I(M). A calibration curve obtained for 200-μm samples prepared by microspotting under the same TIC is also shown in calibration curve, with the slope being 1.024. It can be clearly seen that the calibration curves obtained under the same TIC are almost the same regardless of the sample preparation method and the diameter thereof.

Figure 11A:
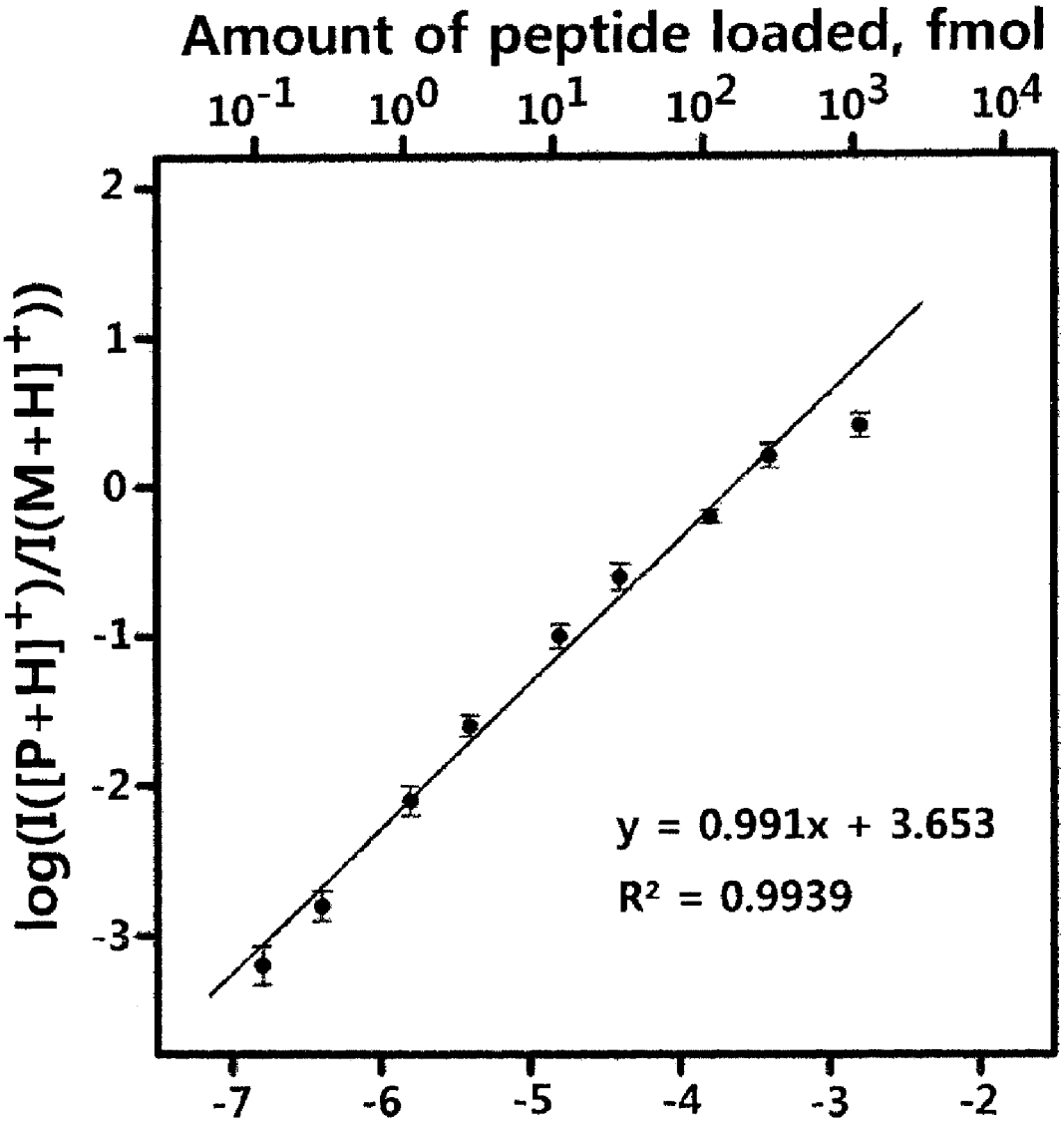
FIGS. 11*a*-11*b* shows calibration curves obtained for (a) a 200-μm sample containing 0.01-1000 fmol of $Y_5K$ in 700 pmol of DHB and (b) a 200-μm sample containing 0.1-5000 fmol of $Y_5K$ in 500 pmol of SA.
Figure 11B:
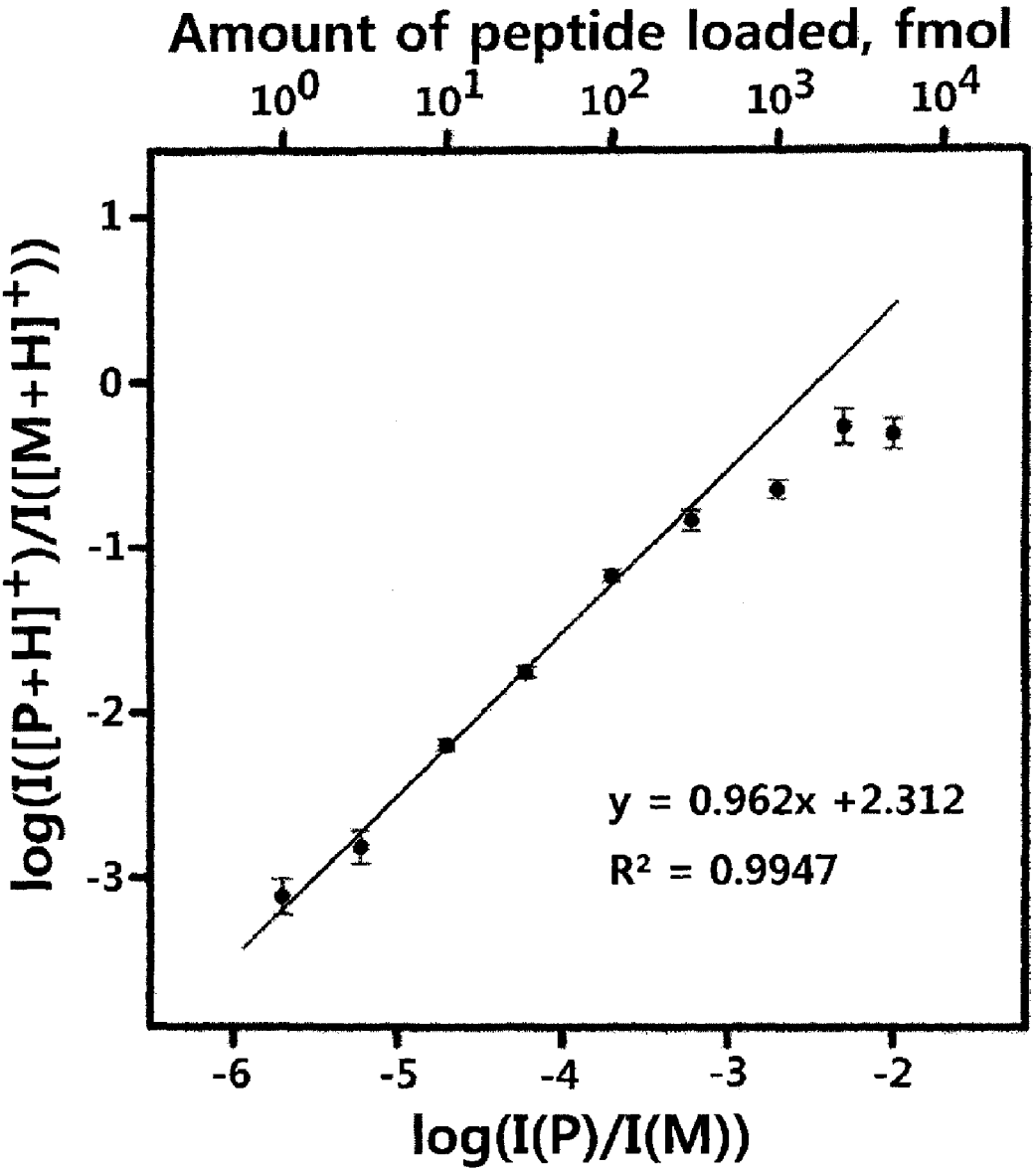

In addition, calibration curves were measured for 200-μm samples with $Y_5K$-to-DHB ratios of 1/7000000-1/7000 and $Y_5K$-to-SA ratios of 1/500000-1/100. As seen from FIGS. 11*a*-11*b*, the two calibration curves were linear over wide dynamic ranges although the linear dynamic range was narrower for CHCA. Suppression was distinct 60% or higher in DHB-MALDI and 50% for SA.

Figure 12:
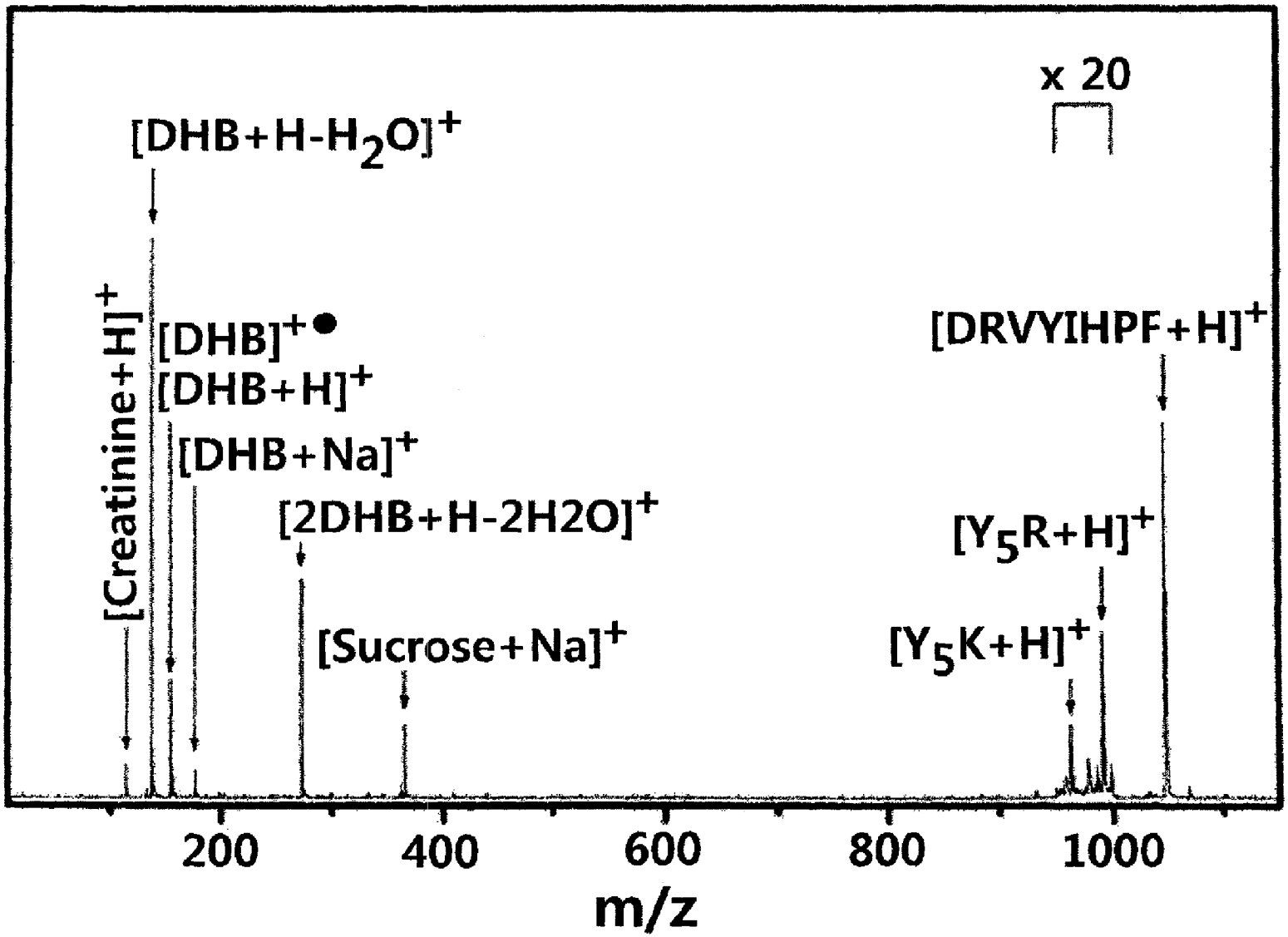
FIG. 12 shows a MALDI spectrum of a 200-μm sample containing 1.0 fmol of $Y_5K$, 1.0 fmol of $Y_5R$, 60 fmol of DRVYIHPF, 10 fmol of creatinine and 3 pmol of sucrose in 700 pmol of DHB.

In the case where there are two or more analytes in a sample wherein a proton exchange reaction from the matrix to the analyte occurs in a high-pressure early plume, if the reaction for one of the analytes is in quasi-equilibrium then the reaction for the other analyte(s) is also in quasi-equilibrium. In this case, the calibration curve of Equation (6) is valid for each analyte regardless of the presence of other analyte(s). For reliable quantitation, the matrix suppression expressed by Equation (8) in the MALDI spectrum of the contaminated sample should be lower than a certain limit, e.g. 70% or lower for CHCA. To confirm whether the quantitation of an analyte in a 200-nm sample is possible according to this guideline, a sample containing 1.0 fmol of $Y_5K$, 1.0 fmol of $Y_5R$, 60 fmol of DRVYIHPF (angiotensin II), 100 fmol of creatinine and 3 pmol of sucrose in 700 pmol of DHB was prepared. The MALDI spectrum obtained from the samples under TIC of 1200±200 particles/pulse is shown in FIG. 12. Among the analytes in the sample, $Y_5K$ and $Y_5R$ were quantitated using their calibration curves. One-point data were obtained for angiotensin II and creatinine from a 100-fmol sample and the analytes in the mixture were quantitated using Equation (6). The quantitative analysis result is shown in Table 3. It can be seen that the quantitation result agrees well with the preparation amount.

TABLE 3

Quantitative analysis result for analytes in mixture under 40% matrix signal suppression

| Analyte | Loading amount, fmol | Determined amount, fmol |
|---|---|---|
| $Y_5K^a$ | 1.0 | 1.1 ± 0.2 |
| $Y_5R^a$ | 1.0 | 1.1 ± 0.2 |
| DRVYIHPF[b] | 60 | 69 ± 11 |
| Creatinine[b] | 100 | 87 ± 10 |

[a]A calibration curve, i.e. $I([P+H]^+)/I([M+H]^+)$ vs. $I([P])/I([M])$, was used for quantitative analysis.
[b]One-point calibration was performed.

The invention claimed is:

1. A method for measuring the equilibrium constant of a proton exchange reaction between a matrix and an analyte at constant temperature, the method comprising:

(i) obtaining MALDI mass spectra having the same total ion count (TIC) by adjusting the intensity of energy applied to a sample having a predetermined amount of matrix and a predetermined amount of analyte mixed therein; and (ii) measuring the value obtained by dividing the signal intensity of the analyte ion by the signal intensity of the matrix ion (ion signal ratio) from the MALDI mass spectra obtained in the step (i), wherein the ion signal ratio is divided by the concentration of the analyte divided by the concentration of the matrix (concentration ratio) to measure the equilibrium constant.

2. The method according to claim 1, wherein a means of applying energy to the sample is a laser.

3. The method according to claim 2, wherein the laser is a nitrogen laser or a Nd:YAG laser.

4. The method according to claim 3, wherein the laser is irradiated to one spot of the sample multiple times.

5. The method according to claim 3, wherein the laser is irradiated to multiple spots of the sample.

6. A method for obtaining a calibration curve for MALDI mass spectrometry, the method comprising:

(i) obtaining MALDI mass spectra having the same total ion count (TIC) by adjusting the intensity of energy applied to a sample having a predetermined amount of matrix and a predetermined amount of analyte mixed therein;

(ii) measuring the value obtained by dividing the signal intensity of the analyte ion by the signal intensity of the matrix ion (ion signal ratio) from the MALDI mass spectra obtained in the step (i); and (iii) obtaining a calibration curve for MALDI mass spectrometry by plotting the ion signal ratio against the concentration of the analyte divided by the concentration of the matrix (concentration ratio).

7. The method according to claim 6, wherein a means of applying energy to the sample is a laser.

8. The method according to claim 7, wherein the laser is a nitrogen laser or a Nd:YAG laser.

9. The method according to claim 8, wherein the laser is irradiated to one spot of the sample multiple times.

10. The method according to claim 8, wherein the laser is irradiated to multiple spots of the sample.

11. The method according to claim 7, wherein the size of the sample is equal to or smaller than the spot size of the laser beam.

12. A method for quantitative analysis of an analyte using MALDI mass spectrometry, the method comprising:

(i) obtaining MALDI mass spectra having the same total ion count (TIC) by adjusting the intensity of energy applied to a sample having a predetermined amount of matrix and a predetermined amount of analyte mixed therein;

(ii) measuring the value obtained by dividing the signal intensity of the analyte ion by the signal intensity of the matrix ion (ion signal ratio) from the MALDI mass spectra obtained in the step (i); and (iii) calculating the molar concentration of the analyte by substituting the molar concentration of the matrix and the ion signal ratio obtained in the step (ii) into a calibration curve for MALDI mass spectrometry of Equation (7)

$$[A]=(I_{AH^+}/I_{MH^+})[M]/K \quad (7).$$

13. The method according to claim 12, wherein a means of applying energy to the sample is a laser.

14. The method according to claim 13, wherein the laser is a nitrogen laser or a Nd:YAG laser.

15. The method according to claim 14, wherein the laser is irradiated to one spot of the sample multiple times.

16. The method according to claim 14, wherein the laser is irradiated to multiple spots of the sample.

17. The method according to claim 13, wherein the size of the sample is equal to or smaller than the spot size of the laser beam.

* * * * *